US012276181B1

(12) United States Patent
Fripp et al.

(10) Patent No.: US 12,276,181 B1
(45) Date of Patent: Apr. 15, 2025

(54) POWER GENERATION FOR WELLBORE DEVICES

(71) Applicant: Halliburton Energy Services, Inc., Houston, TX (US)

(72) Inventors: Michael Linley Fripp, Singapore (SG); Stephen Michael Greci, Carrollton, TX (US); Kanishk Parmar, Singapore (SG)

( * ) Notice: Subject to any disclaimer, the term of this patent is extended or adjusted under 35 U.S.C. 154(b) by 0 days.

(21) Appl. No.: 18/502,555

(22) Filed: Nov. 6, 2023

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS

| | | | | |
|---|---|---|---|---|
| 5,839,508 | A | 11/1998 | Tubel et al. | |
| 7,093,674 | B2 * | 8/2006 | Paluch | E21B 7/068 73/152.28 |
| 7,246,660 | B2 | 7/2007 | Fripp et al. | |
| 8,581,427 | B2 * | 11/2013 | Schoonover | E21B 41/0085 290/1 R |
| 10,619,435 | B2 | 4/2020 | Greci et al. | |
| 11,255,143 | B2 * | 2/2022 | Marshall | E21B 41/0085 |
| 2008/0047753 | A1 | 2/2008 | Hall et al. | |
| 2013/0153242 | A1 | 6/2013 | Flight et al. | |
| 2016/0145975 | A1 * | 5/2016 | Carroll | H02K 7/1823 166/244.1 |
| 2017/0284219 | A1 * | 10/2017 | Hunter | F03B 13/00 |
| 2022/0034179 | A1 | 2/2022 | Parkin et al. | |

FOREIGN PATENT DOCUMENTS

WO 2018125048 7/2018

OTHER PUBLICATIONS

"PCT Application No. PCT/US24/39071 International Search Report and Written Opinion", Oct. 31, 2024, 14 pages.

* cited by examiner

*Primary Examiner* — Brad Harcourt
(74) *Attorney, Agent, or Firm* — DeLizio, Peacock, Lewin & Guerra LLP

(57) ABSTRACT

Various examples of self-contained electrical power generation assemblies are described, the assemblies configured to generate electrical power using a flow of fluid flowing through a conduit configured as part of a wellbore tool or wellbore production tubing, the electrical power generation assemblies configured to be located downhole at various positions along a drill string, a section of production tubing, or some other type of conduit configured to provide a fluid passageway for a flow of one or more types of fluid within a wellbore.

17 Claims, 15 Drawing Sheets

POWER GENERATION FOR WELLBORE DEVICES

TECHNICAL FIELD

This disclosure relates generally to wellbore apparatus and methods configured to operate downhole tools in a wellbore.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different phases, such as drilling a wellbore at a desired well site, cementing the well, treating the wellbore to optimize production of hydrocarbons, and producing and processing the hydrocarbons from the subterranean formation for downstream use.

BRIEF DESCRIPTION OF THE DRAWINGS

Embodiments of the disclosure may be better understood by referencing the accompanying drawings.

Figure 1A:
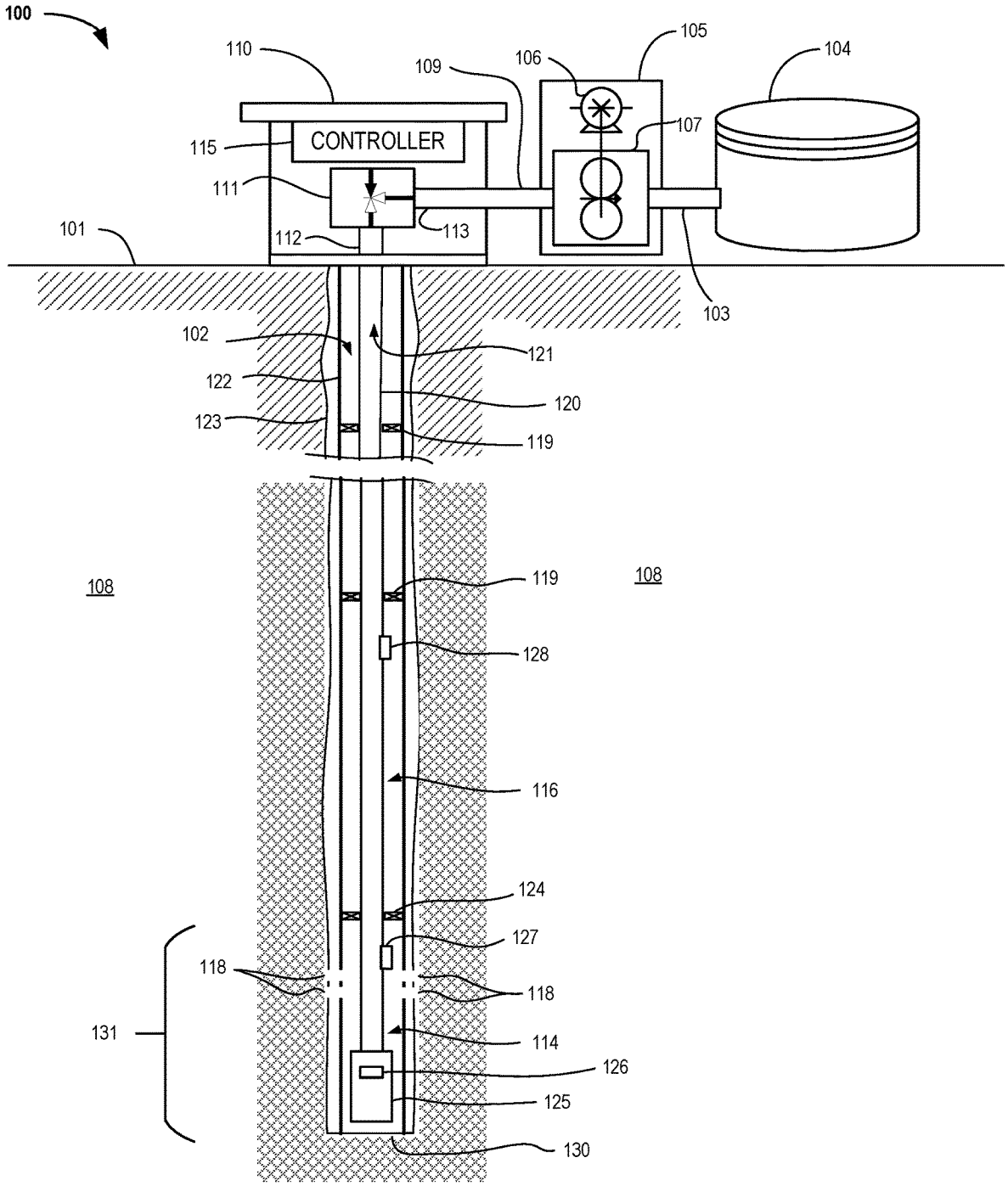
FIG. 1A illustrates a diagram of a wellbore system configured for production of hydrocarbons or other subterranean resources, according to various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. The description that follows includes example systems, methods, techniques, and program flows that embody embodiments of the disclosure. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

The embodiments described herein relate to systems, apparatus, methods, and techniques that utilize self-contained electrical power generation assemblies. Embodiments of these assemblies utilize a flow of fluid, such as drilling fluid, wellbore treatment fluids, and/or production fluids, as an input source of energy to operate an electrical generator, which in turn may be used to power electrical devices and circuitry that can be positioned downhole as part wellbore equipment that requires electrical power to operate, and wherein a wired connection to a remote source of electrical power, or a battery source of electrical power located downhole, may not be ideal and/or practical.

In general, providing electrical power is a challenge for completion setups in a wellbore. For wireless applications, there is a need to convert some of the flow energy from a fluid flow into electrical energy, which can be referred to as "flow harvesting." Flow harvesting is difficult in straight pipe or anywhere else where there is no flow restriction, and it is difficult to add a flow restriction to production tubing without also interfering with tool passage through the production tubing. In flow harvesting, the available power in a liquid flow is equal to the volumetric flow rate times the pressure drop. In straight production tubing, there can be a lot of flow rate of the fluid. However, the pressure drop along the unrestricted section of tubing is very small. As a result, power generation is generally not practical, or even possible. Embodiments of the devices, systems, methods and techniques as described herein relate to converting flow energy into electrical energy, for example in a straight pipe or conduit, without also overly restricting tool passage. In various embodiments, a flow restrictor is deployable to extend into a flow of fluid passing through the pipe or conduit, and when extended creates the pressure drop needed for power harvesting using the power generation assemblies as described herein. In various configurations the flow restrictor is configured to be retracted so as to minimize or eliminate any interaction between the flow of fluid and the level of intrusion of the flow restriction into the flow passageway of the pipe or conduit, thereby allowing unrestricted tool passage through the fluid passageway. In various embodiments, a moveable sleeve or tab is utilized to control deployment and retraction of the flow restrictor, and to ensure that the flow restrictor cannot get caught by tools passing through the area of the pipe or conduit where the flow restrictor is location when used to place the flow restrictor in the retracted configuration. In various embodiments, creating a pressure drop by deploying the flow restrictor to extend into a flow of fluid passing through the pipe or conduit means creating a change in pressure that is significantly larger than a pressure drop that would result from a same flow of fluid in a corresponding section of straight pipe. In various embodiments, the level of the pressure drop that is created by deploying the flow restrictor into a flow of fluid passing through the pipe or conduit in in a range from 2 to 500 pounds-per-square-inch (PSI). In various embodiments involving production or during injection operations being performed on a wellbore, a pressure drop of 50 PSI is normally generated by the deployment of the flow restrictor into the flow of fluid.

FIG. 1A illustrates a diagram of a wellbore system (system) 100 configured for production of hydrocarbons or other subterranean resources, according to various embodiments. Embodiments of system 100 may include one or more power generation assemblies as described herein, for generation of electrical power using a flow of one or more fluids flowing within system 100. As shown in FIG. 1A, various components including a storage reservoir or vessel 104, a fluid pump 105, and a wellhead 110 are located above a surface 101, and proximate a wellbore 102 extending below surface 101 into a formation 108. Although shown as a vertical wellbore, embodiments of a wellbore included in well system 100 may include portions of a wellbore that extend vertically, horizontally, and/or at some non-vertical and/or some non-horizontal angle relative to surface 101, or any combination thereof. Also, although depicted as a terrestrial based system, embodiments of well system 100 may include systems positioned over a body of water such as a river, lake, sea, or ocean.

As shown in FIG. 1A, embodiment of system 100 include a casing 122 extending within wellbore 102 from surface 101 to or near wellbore bottom 130. The casing may be cemented in place by cement 123 located between the outer surface of the casing 122 and formation 108. A tubing string 120 extends within the casing 122, the tubing string comprising one or more sections of hollow conduit coupled together to form a fluid passageway 121 extending through the tubing string. One or more sets of centralizers 119 may be positioned along the tubing string 120 and within casing 122 to stabilize and secure the tubing string within the casing. One or more packers 124 may be positioned along the tubing string near the bottom of the wellbore 102. The one or more packers are configured to isolate a portion of the annulus located between the tubing string 120 and the inner surface of the casing 122 in order to separate one or more upper portions 116 of the annulus from a lower portion 114 of the annulus in order to create an isolated pickup zone within the lower portion 114 of the annulus. The lower portion 114 of the annulus corresponds to a location within the wellbore that is adjacent to a production zone of the formation 108, the production zone generally indicated by bracket 131.

As shown in FIG. 1A, one or more sets of perforations 118 are formed in the casing 122 and extending through cement 123 to provide fluid communication between the production zone of formation 108 and the lower portion 114 of the annulus. Fluids, such as hydrocarbons or other subterranean resources present in the production zone 131 of formation 108, enter the lower portion 114 of the annulus, and may then be transported upward through fluid passageway 121 of tubing string 120 to and above surface 101. In some embodiments, the pressure of the fluids present in the production zone 131 is adequate to push the fluid(s) up through the fluid passageway 121 of the tubing string to the wellhead 110. However, in most instances a device, such as a downhole fluid pump 125 is coupled to the tubing string 120, the fluid pump configured to take in fluid(s) present in the annulus of the pickup zone 114 and pump the fluid(s) up tubing string 120 through fluid passageway 121 to the wellhead 110.

As fluid(s) moving upward through the tubing string 120 arrive at surface 101, they enter wellhead 110 through valve inlet 112, and are further routed and controlled by valves 111. Valves 111 are configured to provide an output of the fluids arriving at the wellhead 110 through valve outlet 113, which in various embodiments is coupled to the fluid pump assembly 105 including an above-surface pump 107 that is driven by motor 106. As illustrated in FIG. 1A, vessel 104 is coupled to fluid pump 105 through fluid conduit 103, wherein fluid pump 105 is coupled to wellhead 110 through fluid conduit 109. Vessel 104 may be any type of container, such as a tank, which can receive and hold for storage, fluids received from the wellbore. Fluid pump assembly 105 is configured to provide additional fluid pressure and/or flow control functionality that is utilized to deliver the fluid(s) arriving at wellhead 110 and are to be moved for storage at vessel 104. In various embodiments, fluid pump assembly 105 is needed to move the fluids from the wellhead 110 to vessel 104 due to the distances between these devices. In other embodiments, the downhole pump 125 provides adequate fluid pressure and flow rates to move fluid(s) provided from the wellbore to vessel 104 without the need for the addition of fluid pump assembly 105.

In alternative embodiments of the well system 100 of FIG. 1A, the system is configured to perform injection of water-based, CO2-laden, and/or energy-rich fluids like elemental hydrogen (H2) into the formation 108, for example for subterranean storage of the injected fluid(s). In these embodiments, fluid pump 105 may be configured to pump fluid from vessel 104 through the valves 111 and downward into wellbore 102 directly, and/or into tubing string 120, in either case to be injected under pressure into formation 108, for example through perforations 118. In these embodiments, the flow(s) of the injected fluid may be used to operate any of the embodiments of the power generation apparatus described herein in order to generate electrical power to operate electrical devices.

In the operation of system 100, it may be important to operate various electronic devices, such as devices configured to provide downhole communications between devices downhole and/or between devices downhole and devices located above surface 101, and for example to operate sensor to gather data and monitor the operations of the wellbore downhole. Because system 100 is configured as a production system, portions of the system, such as the tubing string 120, may remain in location with wellbore 102 for extended periods of time, for example for months or years. These extended time period may render the use of remote power sources, such as batteries to power downhole electrical devices, impractical due to limited battery lifespans. Also, in various embodiments, powering these downhole devices using power sources provided above surface 101 and electrically coupled to the downhole electronic devices may be expensive and complicate the system with addition electrical connections that may be prone to failure over time. Thus, the self-contained electrical power generation assemblies as described herein can be a better or an ideal solution to providing electrical power to one or more downhole devices included in system 100.

These electrical power generation assemblies may be located at various location downhole. For example, as shown in FIG. 1A an electrical power generation assembly 126 may be included as part of fluid pump 125, and configured to use a flow of fluid(s) moved through tubing string 120 to provide the input energy to operate the power generation assembly. Power generation assembly 126 may include various sensors configured to sense parameters associated with fluid pump 125, such as vibration, temperature, output pressure and/or a volume of fluid(s) being pumped by fluid pump into the tubing string 120. In various embodiments, a power generation assembly may be located along tubing string 120, for example power generation assembly 127 located along a portion of the tubing string 120 positioned within the pickup zone 114 annulus, and/or located along a portion of the tubing string 120 positioned within the upper portion 116 of the annulus, as illustratively represented by power generation assembly 128. The power generation assembly 127 and 128, when present, may utilize the flow of production fluid(s) flowing through fluid passageway 121 to provide the energy input to operate these power generation assemblies. The power generation assembly 127 and 128, when present, may be utilized to operate one or more sensors, such as temperature, pressure, and/or flow rate sensors monitoring one or more parameters of the fluids flowing through fluid passageway 121 in the vicinity of the respective power generation assemblies. The power generation assemblies may also be used to power electronics that are used to provide telemetry, including operating devices configured to provide mud-pulse telemetry, between one or more downhole devices and other devices, such as controller 115, which may be located downhole and/or above surface 101.

Figure 9:
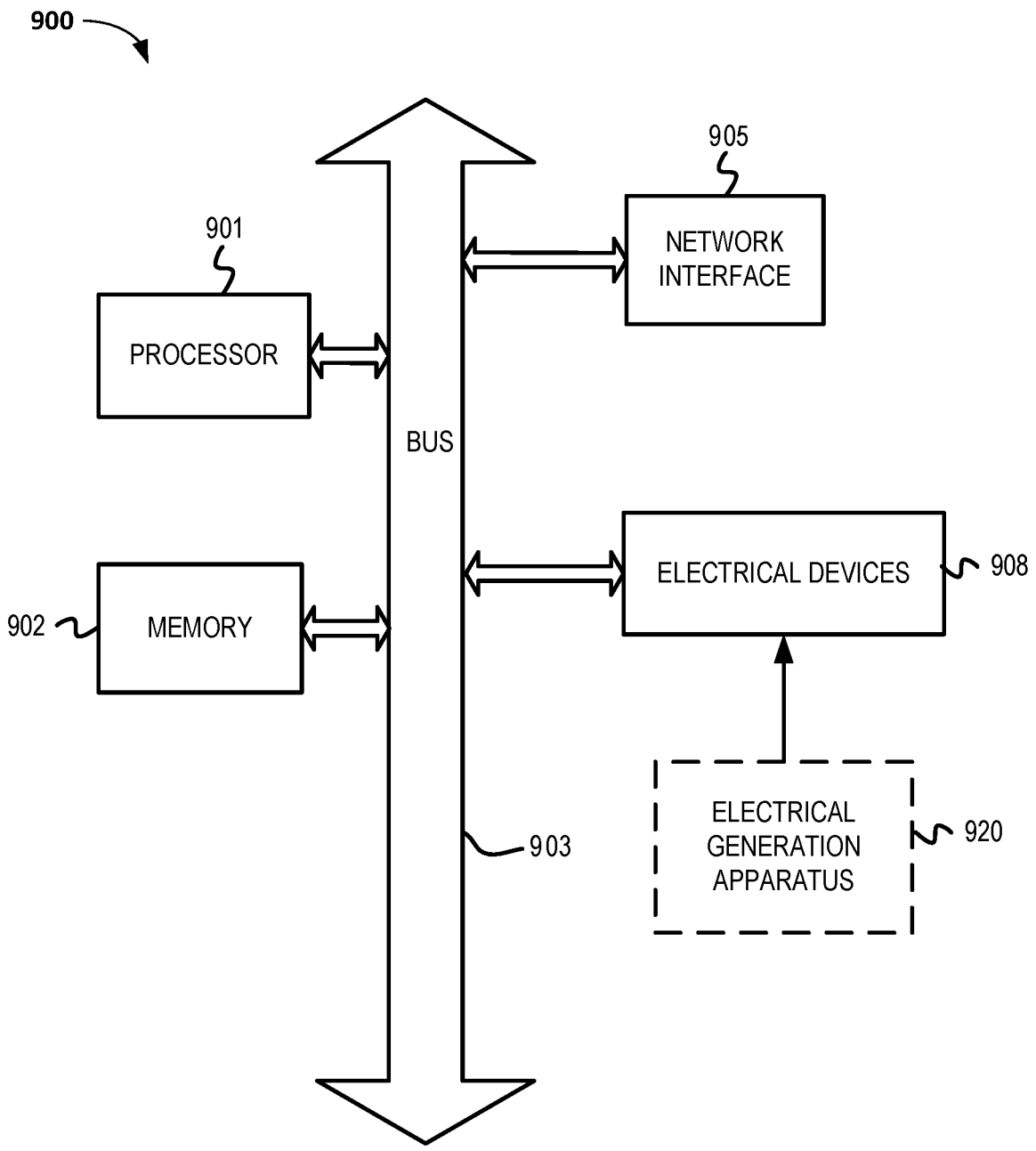
FIG. 9 illustrates a block diagram of an example computing system that may be employed to practice the concepts, methods, and techniques as disclosed herein, and variations thereof.

Controller 115, which may comprise a computing device with one or more processors and other computing devices, such a computer memory, may be coupled to devices such as the one or more valves 111, and configured to control the operation of the one or more valves 111. In various embodiments, controller 115 may also be configured to control the operation of the downhole fluid pump 125 and/or fluid pump 105 in order to regulate the pressure and/or the flow rate of fluid(s) being provided to the wellhead 110 and/or being transferred to vessel 104. Controller 115 may be configured to communicate with, using one or more forms of telemetry, any of the power generation assemblies, such as power generation assemblies 126, 127, and/or 128, which may be included as part of system 100. Controller 115 may include any of the devices and be configured to perform any of the functions described below with respect to user interface 150 (FIG. 1B) and/or associated with computer system 900 (FIG. 9).

Figure 1B:
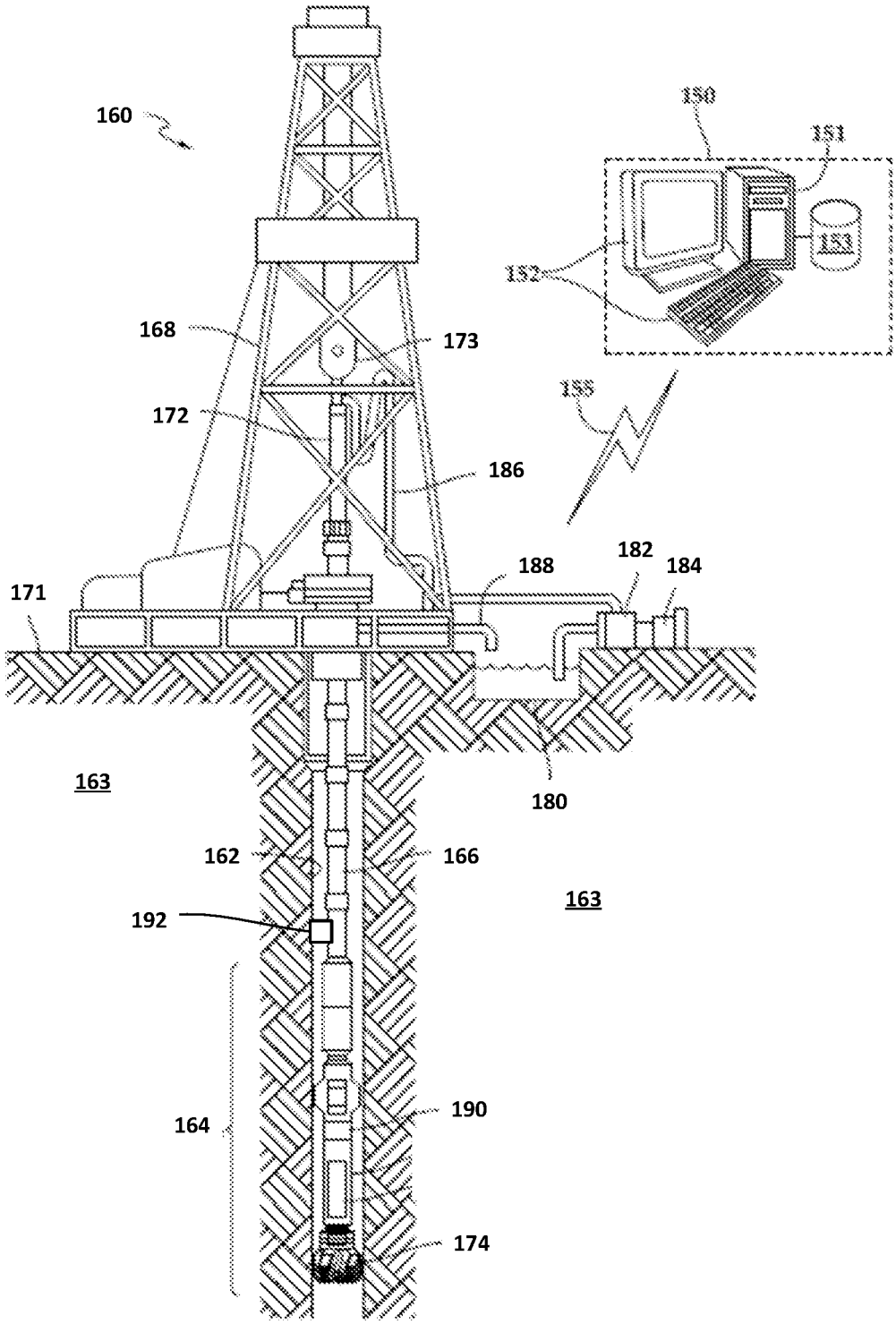
FIG. 1B illustrates a diagram of an embodiment of a well system in accordance with various embodiments.

FIG. 1B illustrates a diagram of an embodiment of a well system 160 in accordance with various embodiments. Well system 160 is configured to utilize a downhole tool that includes a drill string, generally indicated by bracket 164, the drill string including a drill bit 174, the combination configured to perform drilling operations on the wellbore 162 of well system 160. Embodiments of well system 160 may be configured to move and position a bottom hole assembly (BHA) 164, which may be coupled to a conduit 166 of some type, such as a drill string, which extends from the surface 171 of the well system into the wellbore 162. The conduit 166 may extend from a derrick 168 arranged at the surface 171. Derrick 168 may include a kelly 172 and a traveling block 173 used to lower and raise kelly 172 and conduit 166. Although shown as a vertical wellbore, embodiments of a wellbore included in well system 160 may include portions of a wellbore that extend vertically, horizontally, and/or at some non-vertical and non-horizontal angle relative to surface 171, or any combination thereof. Also, although depicted as a terrestrial based system, embodiments of well system 160 may include systems positioned over a body of water such as a river, lake, sea, or ocean.

During a drilling operation, drill bit 174 penetrates the formation 163, and thereby creates and extends wellbore 162. As part of a drilling operation, drilling fluid from a drilling fluid tank 180 may contain a quantity of drilling fluid that is pumped downhole using a pump 182 powered by an adjacent power source, such as a prime mover or motor 184, located above surface 171. The drilling fluid may be pumped from the tank 180, through a standpipe 186, which feeds the drilling fluid into conduit 166, which conveys the drilling fluid to drill bit 174. The drilling fluid exits one or more nozzles arranged in drill bit 174, and in the process cools the drill bit. After exiting drill bit 174, the drilling fluid circulates back to the surface 171 via the annulus defined between wellbore 162 and conduit 166, and in the process, returns drill cuttings and debris to the surface. The returning cuttings and mud mixture are passed through a flow line 188 and are processed such that a cleaned drilling fluid is returned to tank 180 and is available to be recirculated downhole through standpipe 186.

In various embodiments the BHA 164 is configured to communicate with one or more other computer devices, such as user interface 150, which may be located above surface 171, and proximate the site of the wellbore 162, or remotely located from the site of the wellbore. User interface 150 may include a computing device 151, such as a personal computer, a lap-top computer, or some other type of user interface device, such as a smart phone. In various embodiments, user interface 150 includes one or more input/output devices 152, for example a display device such as a computer monitor, which is configured to provide visual display of data and other information related to well system 160 and/or to a fluid treatment process being performed on or modeled for wellbore 162. In various embodiments, the display device is configured to display information regarding data received at user interface 150 from the BHA 164 related to the status and/or other parameters associated with the operation of the BHA or other devices included in well system 160. The computer system of user interface 150 may include one or more additional input devices, such as a computer keyboard, computer mouse, and/or a touch screen that allows a user, such as a technician or engineer, to provide inputs to user interface 150, which may include requests for information regarding the status of well system 160 and/or inputs that may be used to direct the operations of the well system 160.

In various embodiments, communications between user interface 150 and BHA 164 may include instructions and/or data configured for the operation of the drill bit 174. Communications between the BHA 164 and the user interface 150 may include transmission of data, in some embodiments in real time, resulting from the testing and/or measurements performed by the BHA 164, and which may be derived from one or more of sensors. Connections between user interface 150 and other devices included in in well system 160 may be provided by wired and/or wireless communication connection(s), as illustratively represented by lightning bolt 155.

User interface 150 is communicatively coupled to a non-volatile computer readable memory device 153. Memory device 153 is not limited to any particular type of memory device. Memory device 153 may store instructions, such as one or more applications, that when operated on by the processor(s) of the computing device 151, are configured to control the operations of one or more of the devices included in well system 100. Any combination of one or more machine-readable medium(s) may be utilized. The machine-readable medium may be a machine-readable signal medium or a machine-readable storage medium. A machine-readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

System 160 includes one or more self-contained power generation assemblies (assemblies, 190, 192), which are configured to generate electrical power by harvesting energy from a flow of fluid or fluids, such as the drilling fluid flowing down through conduit 166 and/or the flow of fluids returning to surface 171 through the annulus as described above. Each of the power generation assemblies, such as assemblies 190 and 192, may include one or more sensors. The sensors may be configured to sense one or more physical parameters associated with the wellbore and/or the operation of the BHA 164, such as the rotational speed of the BHA 164. Additional parameters that may be sensed by sensors can include temperatures at various locations within the wellbore, levels of torque being produced by the rotation of the drill string, and/or levels of vibration occurring at the BHA 164 and/or within conduit 166. The sensors are configured to produce an output signal, such as an electrical or optical output signal, which may be received at a device such as a downhole computing system, and processed in order to determine one or more control instructions for further operations being performed on the well system. For example, sensor output signals provided by one or more of sensors may be processed and used by a computing system to determine one or more operating parameters to be used for the operation of the BHA 164. In various embodiments, the electrical power required to operate these sensor and/or to provide the output signals and communication signals related to these sensors is generated downhole by each of the individual power generation assemblies, respectively.

In various embodiments the BHA 164 is configured to communicate with one or more other computer devices, such as user interface 150, which may be located above surface 171, and proximate the site of the wellbore 162, or remotely located from the site of the wellbore. The electrical power needed to provide such communications may be generated by using a self-contained power generation assembly, such as assembly 190.

Figure 2A:
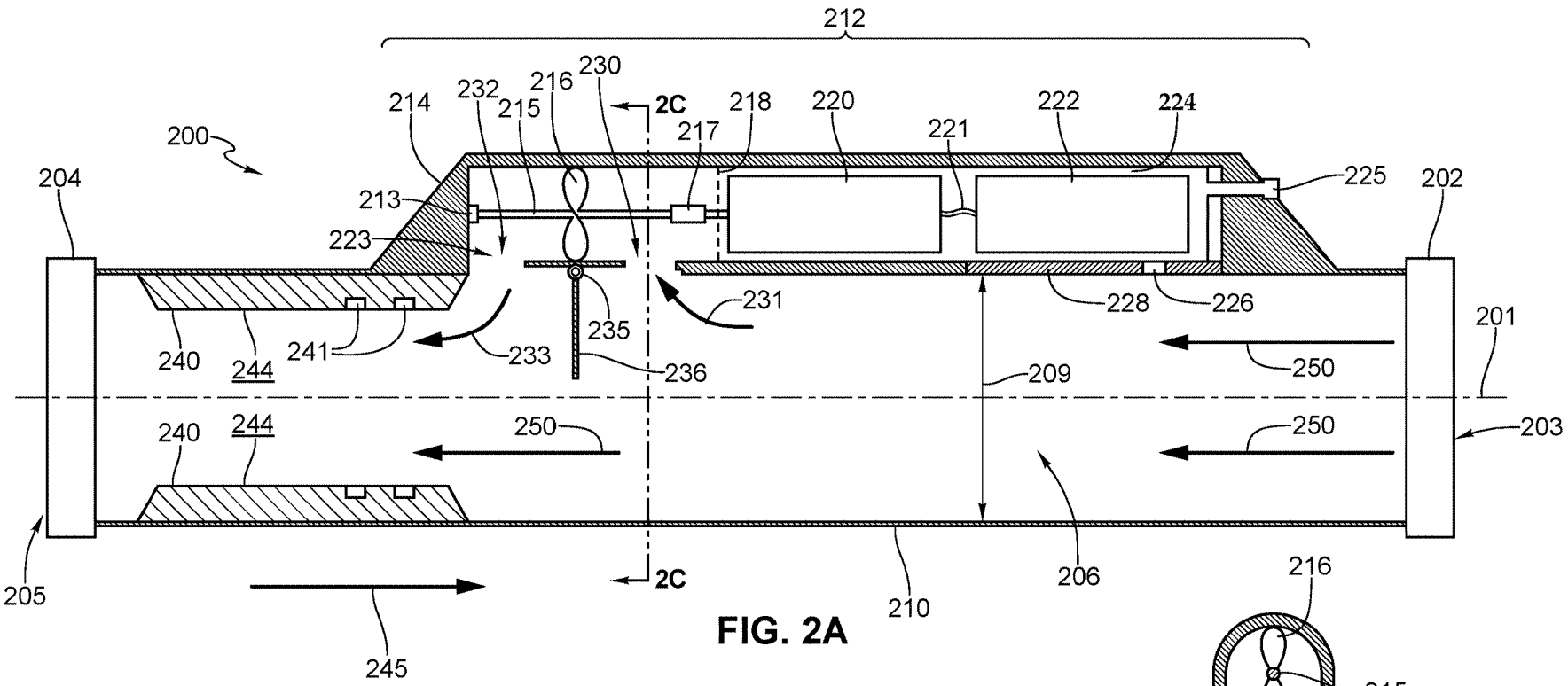
FIG. 2A illustrates a cut-away view of a power generation assembly for downhole tools in accordance with various embodiments.

FIG. 2A illustrates a cut-away view of a power generation assembly 200 for downhole devices, in accordance with various embodiments. As shown in FIG. 2A, power generation assembly 200 (assembly 200) includes a power generation apparatus, generally indicated by bracket 212 (hereinafter "power generation apparatus" or "apparatus" 212), positioned along a conduit 210. Apparatus 212 may be arranged in a housing body 214, which may be formed of a metal material, such as steel, and attached, for example by welding, to conduit 210. The power generation apparatus 212 of assembly 200 is configured to generate electrical power that may be used to power one or more electrical devices 222 included in the power generation assembly using a flow of fluid, illustratively represented by arrows 250, which is moving through a fluid passageway 206 formed within and extending through conduit 210. In various embodiments, fluid passageway 206 comprises a generally circular shape in cross-section, having a diameter 209 in a range of 2.5 to 25.4 centimeters, (1 to 10 inches).

In various embodiments, conduit 210 includes a section of pipe or a casing that extends along longitudinal axis 201, encircling the longitudinal axis to partially enclose the fluid passageway 206 extending from a first end 202 to a second end 204 of conduit 210. First end 202 of conduit 210 comprises a first end opening 203 that is open to and in fluid communication with fluid passageway 206. Second end 204 of conduit 210 comprises a second end opening 205 that is also open to and in fluid communication with fluid passageway 206. In various embodiments, first end 202 comprises a coupling, such as a threaded coupling, that allows the first end 202 to be mechanically coupled to another vessel, such as another section of pipe or a wellbore casing (not shown in FIG. 2A), and second end 204 comprises another coupling, such as a threaded coupling, that allows the second end 204 to be mechanically coupled to another vessel, such as another section of pipe or wellbore casing (also not shown in FIG. 2A). As such, conduit 210 may be coupled in series with other vessels at both the first end 202 and the second end 204 of the conduit, and is configured to receive a flow of fluid (represented by arrows 250) at for example the first opening 203, which flows through the fluid passageway 206 and exits conduit 210 through second opening 205. This flow of fluid through fluid passageway 206 is utilized by the power generation apparatus 212 to generate electrical power, as further described below.

As illustrated in FIG. 2A, assembly 200 includes a movable tab or sleeve 240 that encircles a portion of the longitudinal axis 201, is movable longitudinally relative to the longitudinal axis in a direction illustratively represented by arrow 245, and as shown in FIG. 2A is positioned closer to second end 204 such that the sleeve is clear of a first opening 230 and a second opening 232 of the power generation apparatus 212. In various embodiments, sleeve 240 includes one or more grooves 241 positioned on an inner surface 244, which can be engaged by a tool and used to move sleeve 240 in the direction as indicated by arrow 245, as further described below with respect to FIG. 2B. Sleeve 240 may also be moved from one position to another using a tool or ball designed to engage an end of the sleeve. In various embodiments, the sleeve can have a collet to help hold it in position. In various embodiments, a low-force collet may be used for holding the sleeve in the up position as shown in FIG. 2A, and a high-force collet would be used to hold the sleeve in the down position that covers the flow restrictor as shown in FIG. 2B. The higher force collet force may be used in order to ensure that the sleeve does not accidentally shift due to friction from the tool passage when the sleeve is in the position as shown in FIG. 2B. In addition to a collet, alternative motion arresters could be used including detents, magnetic attraction, magnetic repulsion, and mechanical friction to hold sleeve 240 in a desired location. Embodiments of the sleeve 240 or otherwise as described throughout this disclosure have a thickness dimension radially extending from the longitudinal axis 201 that is thin, in various embodiments less than the drift diameter of the tubing where the sleeve is positioned. In various embodiments the sleeve is positioned within a section of the tubing with a larger ID than other sections of the tubing, thereby allowing the inner surface 244 of the sleeve to be at a same distance radially from the longitudinal axis 201 as the inner surface of the tubing. Further, the sleeve does not act as a flow restrictor as the term "flow restrictor" is utilized throughout this disclosure. A flow restrictor is an object or device that extends into the fluid passageway 206 at least 10 percent of the distance between the internal surface of the tubing and longitudinal axis 201 of the tubing, or covers at least 10 percent of the internal flow area in cross-section of the fluid passageway 206 of the tubing. As defined herein, the sleeve is not a flow restrictor.

When sleeve 240 is positioned as shown in FIG. 2A, first opening 230 and second opening 232 provide fluid communication between fluid passageway 206 and a cavity 223 located within the assembly 200. In addition, when sleeve 240 is positioned as shown in FIG. 2A, flow restrictor 236 is deployed so that the flow restrictor extends away from apparatus 212 and into the fluid passageway 206, wherein the flow restrictor is configured to interact with the flow of fluid (arrow 250) passing through the conduit 210. Flow restrictor 236 may be urged to the extended position by virtue of actuation mechanism 235, which may include an urging device such as a spring, and a hinge mechanism that allows the end of flow restrictor 236 located at the actuation mechanism 235 to rotate while remaining anchored to the apparatus 212.

The positioning of the flow restrictor 236 as extending into the fluid passageway 206 while remaining anchored to a portion of the assembly 212 creates a pressure differential between first opening 230 and second opening 232 when there is a flow of fluid through conduit 210. The pressure differential causes a flow of some of the fluid flowing though fluid passageway 206 to enter cavity 223 through first opening 230, as illustratively represented by arrow 231. The flow of fluid entering cavity 223 through first opening 230 passes by and interacts with impeller 216, and then exits cavity 223 through second opening 232, as illustratively represented by arrow 233. In the process of flowing past and interacting with impeller 216, the flow of fluid causes impeller 216 to be rotated, thereby converting some of the energy from the flow of fluid through cavity 223 into a mechanical rotational movement of the impeller.

Impeller 216 is coupled to shaft 215, wherein shaft 215 is secured at a first end by bearing 213 and at a second end by coupling 217 and the input shaft to generator 220. Due to these mechanical couplings, the rotational movement of impeller 216 in turn rotates shaft 215, which in turn rotates one or more portion of generator 220 through coupling 217, causing generator 220 to generate electrical energy that is output through electrical connection 221, and provided to electronics 222. In various embodiments, generator 220 and electronics 222 are located with a cavity 224 that is isolated from cavity 223 by divider 218, wherein divider 218 is sealed to the housing of apparatus 212 so that fluids and/or other debris, such as solid particles present in the flow of fluid passing though cavity 223, to not reach or otherwise contact the generator 220 or the electronics 222 that are housed within cavity 224. In various embodiments, cavity 224 includes a port 225 that allows for compensation of pressure differentials between cavity 224 and areas outside of the apparatus 212 and outside of conduit 210, and/or allows sensors included in electronics 222 to sense one or more parameters, such as temperature and/or fluid pressures, which are present in the areas adjacent to and outside of apparatus 212 and conduit 210. In various embodiments, cavity 224 includes a port 226 that allows for compensation of pressure differentials between cavity 224 and areas inside of conduit 210, and/or allows sensors included in electronics 222 to sense one or more parameters, such as temperature and/or fluid pressures, which are present in the areas within fluid passageway 206 of conduit 210.

The parameters of the electrical power generated by generator 220 are not limited to a particular set of parameters, and may include various phases, voltage ranges, and current levels associated with the electrical power generated by the operation of the generator. Electrical power generated by generator 220 in some embodiments is direct current, or is alternating current having single phase power, 2-phase power, or three phase power. Voltages generated by generator 220 may include direct current in a voltage range from 0.4 to 29 volts, or single or multi-phase alternating current having a voltage range from 0.4 to 29 volts RMS (root-mean-square)). Current levels that may be provided by generator 220 in various embodiments range from 0.2 milliamps to 9 amps. In various embodiments, further processing of the electrical power generated by generator 220, such as rectification functions, filtering, and waveform conditioning may be performed by generator 220, and/or by additional circuitry provided in electronics 222 and performed on the electrical power provided to electronics though electrical connection 221.

The type and configuration of electronic devices and circuitry included in electronics 222 is not limited to any particular type or configuration of circuitry, and may include electrical conditioning circuitry, one or more sensors, computer circuitry including one or more processors and memory devices, and/or telemetry circuitry. The types of electronic devices including in electronics 222 can be tailored to the application where assembly 200 is to be located within a wellbore and to the features and functions that the apparatus 212 is required to perform. In various embodiments, generator 220 is designed and configured to provide electrical power having electrical parameters designed to correspond to the electrical needs of the electrical devices and circuitry included in electronics 222. For example, in embodiments where electronics 222 includes solid state sensor devices and/or computer devices, generator 220 can be configured to deliver direct current electrical power at a voltage or within a voltage range at which these devices are designed to operate, and to provide a level of current that is adequate to power these types of devices. In various embodiments, electronics 222 may include charge storage devices, such as one or more capacitors, (not shown in FIG. 2A) the storage devices configured to store electrical energy in order to smooth out and/or to continue to power the electrical devices and circuits included in electronics 222 when the flow of fluid through conduit 210, and thus through cavity 223, varies or is absent for a period of time. In various embodiments, a portion 228 of the inner surface of housing body 214 is removable so that electronics 222 may be removed from cavity 224, and/or replaced by another set of electronics 222.

FIG. 2B illustrates a cut-away view of the power generation assembly 200 of FIG. 2A when configured in an idle configuration, in accordance with various embodiments. As shown in FIG. 2B, sleeve 240 has been repositioned along longitudinal axis 201 in a direction indicated by arrow 245. When positioned as shown in FIG. 2B, sleeve 240 covers over both the first fluid opening 230 and the second fluid opening 232 of the power generation apparatus 212, and therefore cavity 223 is not in fluid communication with fluid passageway 206. In addition, when positioned as shown in FIG. 2B sleeve 240 holds the flow restrictor 236 in a retracted position, in various embodiments in a position so that the flow restrictor 236 extend from the actuation mechanism 235 in a direction parallel to longitudinal axis 201, and on the opposite side of sleeve 240 from the inner surface 244 of the sleeve. As such, flow restrictor 236 is separated from contact with any fluid flow (represented by arrows 250) that may be flowing through fluid passageway 206. In addition, any flow of fluid present in fluid passageway 206 is prevented from entering into and/or from exiting first fluid opening 230 and second fluid opening 232 of the power generation apparatus 212.

In various embodiments, power generation assembly 200 would be configured as shown in FIG. 2B during times when the assembly is coupled with additional tubing, pipes, and/or a wellbore casing, but is being positioned, i.e., moved along, within a wellbore before being located at a desired location within the wellbore. Having assembly 200 configured as shown in FIG. 2B during these placement operations provides protection for the power generation apparatus 212 from unwanted fluids entering into the unit and/or from unwanted levels of fluid pressure, fluid compositions, and/or fluid flow rates that might damage the unit during positioning from being able to enter into the apparatus itself.

Further, at various times it may be desirable to shut off the power being generated by apparatus 212 for some reason, for example to allow for repair or replacement of one or more components of the units, such as electronics 222, while the assembly remains in place downhole. For example, in various embodiments a portion 228 of the inner surface of housing body 214 is removable so that electronics 222 may be removed from cavity 224, and/or replaced by another set of electronics 222. Assembly 200 is configured such that when it is again desirable to start generating electrical power using apparatus 212, sleeve 240 may again be repositioned, moving for example in the direction indicated by arrow 246, to a position such as shown in FIG. 2A, wherein the flow restrictor 236 is again extended into the flow of fluid passing through conduit 210, and wherein the first fluid opening 230 and the second fluid opening 232 are again open and in fluid communication with fluid passageway 206, allowing a flow of fluid to pass through cavity 223, driving impeller 216, and rotating generator 220, causing generator 220 to generate electrical power. In various embodiments, the movement of sleeve 240 between the alternative positions as shown in FIGS. 2A and 2B may be achieved using a tool positioned within fluid passageway 206 and that is configured to engage grooves 241 extending into sleeve 240 from the inner surface 244.

Figure 2C:
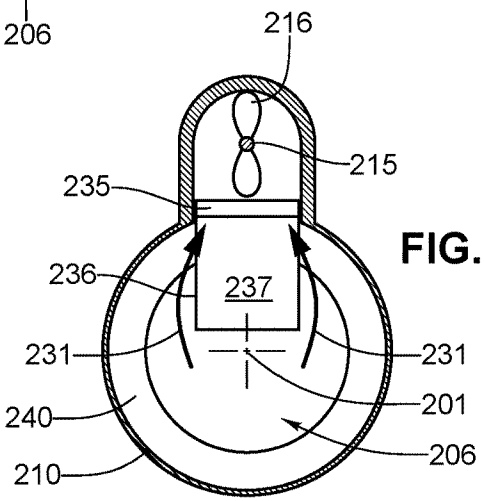
FIG. 2C illustrates a cross-sectional view of the embodiment of power generation assembly taken at line 2C-2C in FIG. 2A.
Figure 2B:
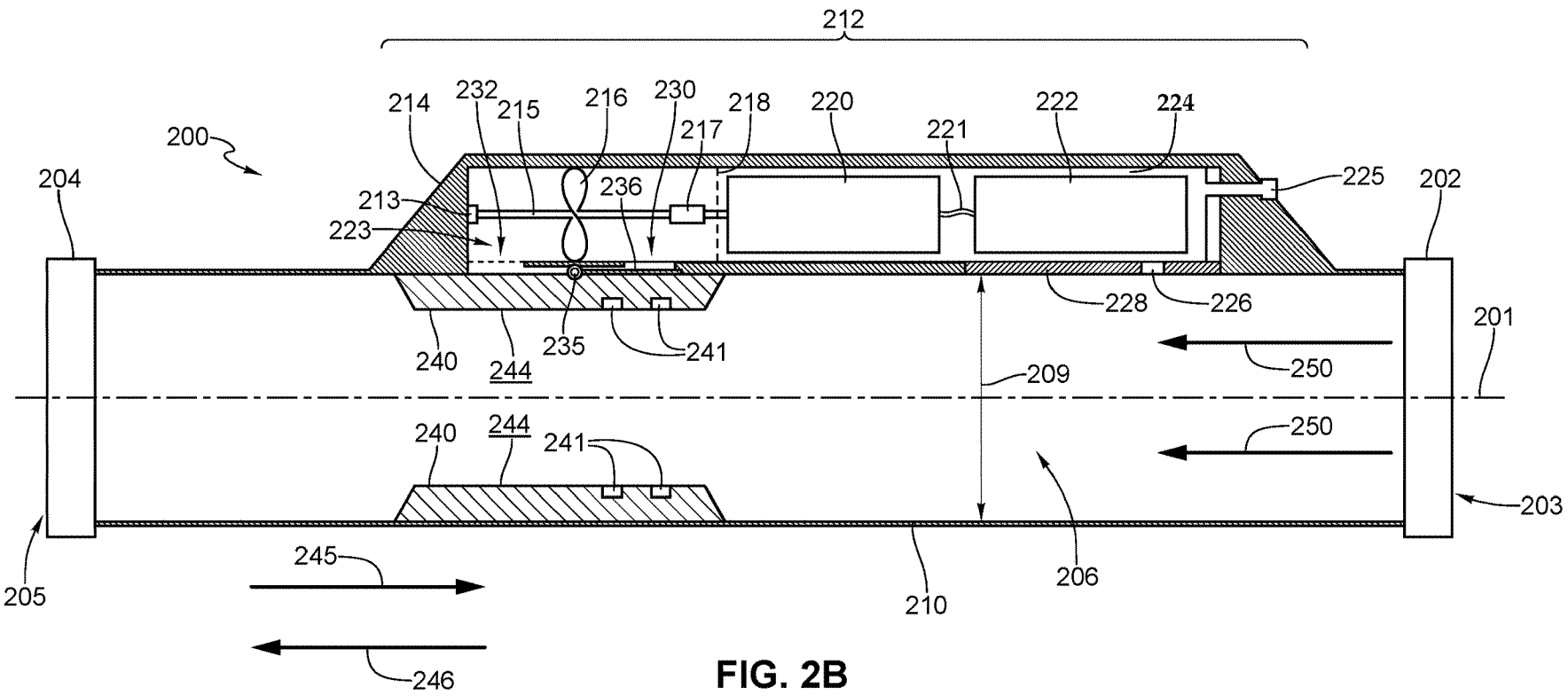
FIG. 2B illustrates a cut-away view of the power generation assembly of FIG. 2A when configured in an idle configuration, in accordance with various embodiments.

FIG. 2C illustrates a cross-sectional view of the embodiment of power generation assembly 200 taken at line 2C-2C in FIG. 2A. As shown in FIG. 2C, sleeve 240 has a cylindrical shape that encircles longitudinal axis 201 and inside of and in contact with an inner surface of conduit 210. Impeller 216 is positioned within cavity 223 of the power generation apparatus 212, which extends away from conduit 210 and is in fluid communication with fluid passageway 206 through first opening 230. As shown in FIG. 2C, flow restrictor 236 extends from actuation mechanism 235 and into fluid passageway 206 in a direction toward longitudinal axis 201. Actuation mechanism 235 includes an urging device, such as a coil spring, which is configured to deploy the flow restrictor 236 into the extended position as shown in FIG. 2A and in FIG. 2C when not retracted and retained by sleeve 240 as illustrated in FIG. 2B.

Referring back to FIG. 2C, flow restrictor 236 includes a flat surface 237 having a height and width dimension configured to provide a flow restriction to a flow of fluid passing through fluid passageway 206, thereby creating a pressure different between first opening 230 and second opening 232 as illustrated and described above with respect to FIG. 2A. In various embodiments, the height and width dimensions of the flow restrictor 236 are formed as a square shaped surface, wherein in other embodiments the height and width dimensions of the flow restrictor 236 are formed as a rectangular shaped surface, having the height dimension perpendicular to the longitudinal axis and being the longer of the two dimensions. However, the shape of the surface of flow restrictor 236 is not limited to any particular shape, and may be some shape other than a square or rectangular shape. In various embodiments, the percentage of cross-sectional area of the fluid passageway 206 that is blocked by the flow restrictor 236 when deployed into the extended position as shown in FIG. 2C is in a range from 10 to 70 percent of the total cross sectional area of the fluid passageway in the area of the flow restrictor in some embodiments. In other embodiments, the percentage of cross-sectional area that is blocked by the flow restrictor 236 when deployed into the extended position is in a range from 5 to 80 percent, with a range from 15 to 50 percent being typical. The dimensions of the surface of flow restrictor 236 can vary as a function of the cross-sectional diameter of the fluid passageway 206 where the flow restrictor is positioned in order to obtain a proper level of pressure differential to operate the assembly 212 in a desired manner.

Figure 3A:
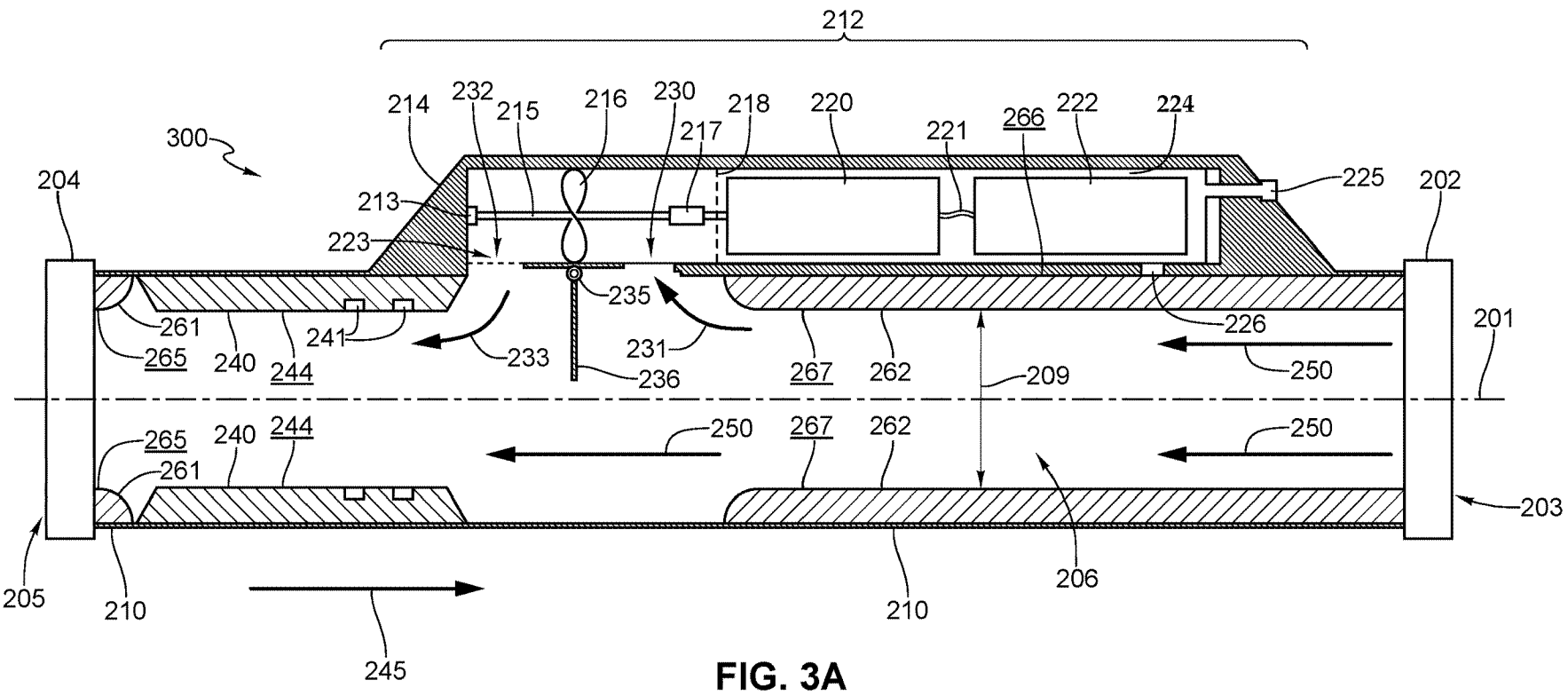
FIG. 3A illustrates a cut-away view of a power generation assembly for downhole tools in accordance with various embodiments.
Figure 3B:
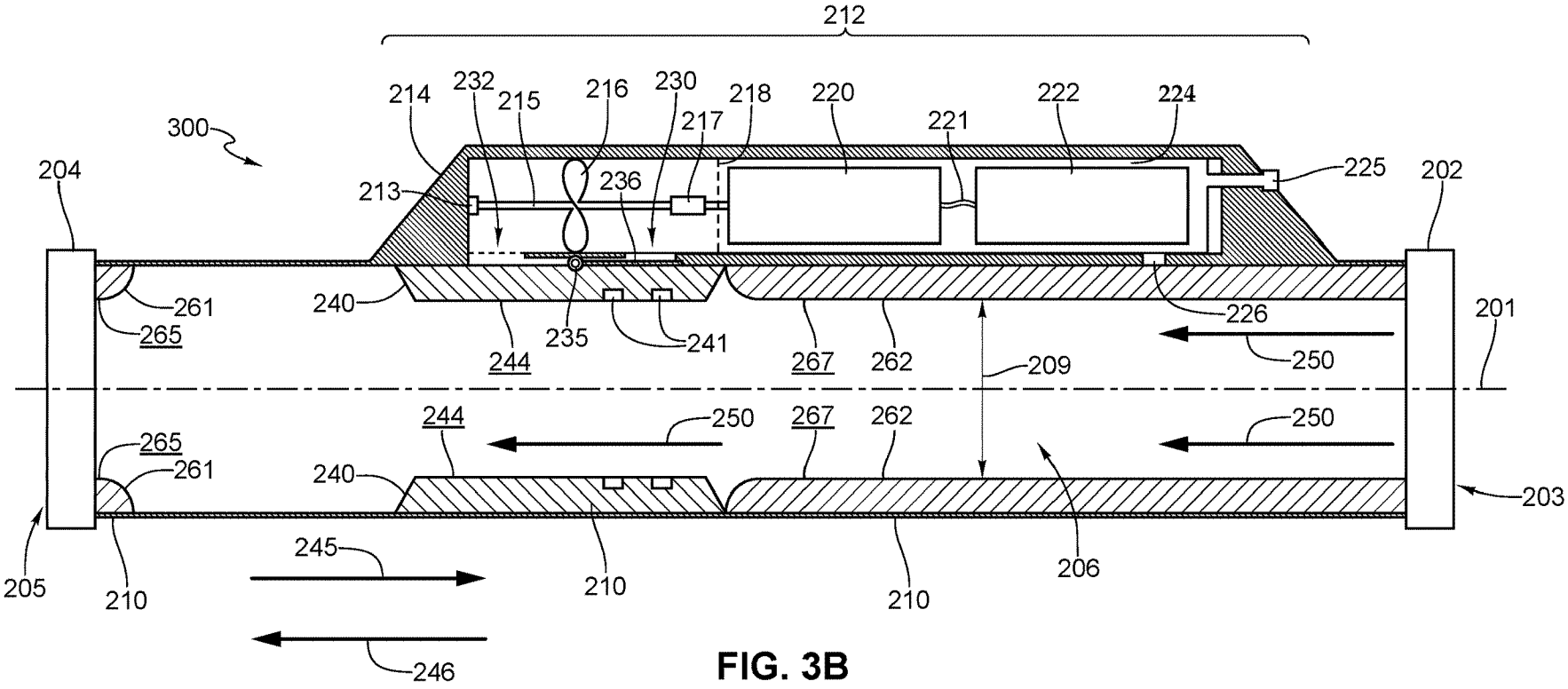
FIG. 3B illustrates a cut-away view of the power generation assembly of FIG. 3A when configured in an idle configuration, in accordance with various embodiments.

FIG. 3A illustrates a cut-away view of a power generation assembly 300 for downhole tools in accordance with various embodiments. Like components included in assembly 300 as shown in FIGS. 3A and 3B and that are the same as and/or perform the same or similar functions as the corresponding parts of assembly 200 (FIGS. 2A-2C), are identified in FIGS. 3A and 3B with a same reference number.

Assembly 300 (FIGS. 3A, 3B) differs from assembly 200 in that assembly 300 includes shoulder elements 261 and shoulder element 262. Shoulder element 261 includes a layer of material having a generally cylindrical shape extending along a portion of the longitudinal axis 201, and having an outer surface 263 in contact with the inner surface of conduit 210. Shoulder element 261 includes an inner surface 265 having a radial distance away from the longitudinal axis 201 that corresponds to inner surface 244 of sleeve 240. In various embodiments, shoulder element 261 includes an end that is away from second opening 205 and having an angular or other shape that may or may not be perpendicular to the longitudinal axis 201, and in some embodiments conforms to the shape of the ends of sleeve 240 that is closest to opening 205, and in other embodiments does not conform to the shape of the end of the sleeve 240 that is closest to opening 205. As shown in FIG. 3A, the end portion of shoulder element 261 that is away from opening 205 has a ramp or curved shape that extends away from sleeve 240. A thickness dimension of shoulder element 261 may be the same as a thickness dimension of sleeve 240 so that the inner surface 265 of shoulder element 261 maintains at least a same radial distance from longitudinal axis 201 as the inner surface 244 of sleeve 240 at all points radially around the longitudinal axis. By doing so, the inner surfaces 265 of shoulder element 261 and inner surface 244 of sleeve 240 provide a smooth and even transition between these surface relative to devices, such as downhole tools, which are moving through fluid passageway 206 in the area where joint between the shoulder elements 261 and sleeve 240 are located.

Embodiments of assembly 300 further include shoulder element 262. Shoulder element 262 includes a layer of material having a generally cylindrical shape extending along a portion of the longitudinal axis 201, and having an outer surface 266 in contact with the inner surface of conduit 210. Shoulder element 262 includes an inner surface 267 having a radial distance away from the longitudinal axis 201 that corresponds to inner surface 244 of sleeve 240. In various embodiments, shoulder element 262 includes an end that is away from first opening 203 and having an angular or other shape that may or may not be perpendicular to the longitudinal axis 201 and that in some embodiments may conform to the shape of the end of the sleeve closest to opening 203, or in other embodiment does not confirms to the shape of the end of the sleeve 240 that is closest to first opening 203. As shown in FIG. 3A, the end portion of shoulder element 262 that is away from opening 205 has a ramp or curved shape that extends away from sleeve 240. A thickness dimension of shoulder element 262 may be the same as a thickness dimension as sleeve 240 so that the inner surface 267 of shoulder element 262 maintains at least a same radial distance from longitudinal axis 201 as the inner surface 244 of sleeve 240 at all points radially around the longitudinal axis. By doing so, the inner surface 267 of shoulder element 261 and inner surface 244 of sleeve 240 provide a smooth and even transition between these surface relative to devices, such as downhole tools, that are moving through fluid passageway 206 in the area where a joint between the shoulder elements 261 and sleeve 240 are located when sleeve 240 is positioned as shown in FIG. 3B and in contact with shoulder element 262. The shoulder elements as described herein are not flow restrictors as defined herein because they do not extend into the fluid passageway 206 at least 10 percent of the distance between the internal surface of the tubing and longitudinal axis 201 of the tubing, or covers at least 10 percent of the internal flow area in cross-section of the fluid passageway 206 of the tubing.

When configured as shown in FIG. 3A, flow restrictor 236 is deployed to be extended in a direction perpendicular to longitudinal axis 201, or at least extending into fluid passageway 206, and positioned to interact with any fluid flowing through fluid passageway 206 in a same or similar manner as described above with respect to FIG. 2A and assembly 200. When configured as shown in FIG. 3A, assembly 300 is configured to receive a flow of fluid through cavity 223, causing impeller 216 to be mechanically rotated and generator 220 to generate electrical power in any manner as described above. In alternative embodiments, instead of having the additional shoulder elements as described above that are formed from separate pieces positioned within the conduit 210, a thicker wall dimension of the conduit 210 may be provided having a step or inset portion having a thinner wall thickness that provides the same or similar function of the shoulder elements as described above, allowing the thicker portion f of the conduit wall to have an inner surface that is flush or nearly flush with the inner surface of the sleeve 240 facing the longitudinal axis 201 of the fluid passageway.

FIG. 3B illustrates a cut-away view of the power generation assembly 300 of FIG. 3A when configured in an idle configuration, in accordance with various embodiments. As shown in FIG. 3B, sleeve 240 has been repositioned along longitudinal axis 201 in a direction indicated by arrow 245. When positioned as shown in FIG. 3B, sleeve 240 covers over both the first fluid opening 230 and the second fluid opening 232 of the power generation apparatus 212. In addition, when positioned as shown in FIG. 3B, sleeve 240 holds the flow restrictor 236 in a retracted position, in various embodiments in a position so that the flow restrictor 236 extend from the actuation mechanism 235 in a direction parallel to longitudinal axis 201, and on the opposite side of sleeve 240 from the inner surface 244 of the sleeve. As such, flow restrictor 236 is separated from contact with fluid flow (represented by arrows 250) that may be flowing through fluid passageway 206. In addition, flow of fluid present in fluid passageway 206 is preventing from entering into and/or from exiting first fluid opening 230 and second fluid opening 232 of the power generation unit.

When configured as shown in FIG. 3B, the end of sleeve 240 closest to first opening 203 is brough into contact with the end of shoulder element 262 farthest from opening 203 so that the inner surface 267 of shoulder element 262 and the inner surface 244 of sleeve 240 correspond to form a smooth transition across the joint between these surfaces. The smooth transition provided between shoulder element 261 when sleeve 240 is positioned as shown in FIG. 3A, and between shoulder element 262 when sleeve 240 is positioned as shown in FIG. 3B, reduces the possibility of tools that are being passed through fluid passageway 206 of the assembly from being caught on sleeve 240, and reduce the potential damage to sleeve 240 that might result from passing of tool through the fluid passageway.

In various embodiments, power generation assembly 300 would be configured as shown in FIG. 3B during times when the assembly is coupled with additional tubing, pipes, and/or casing but is being positioned, i.e., moved along, within a wellbore before being located at a desired location within the wellbore. Having assembly 300 configured as shown in FIG. 3B during these placement operations provides protection for the power generation apparatus 212 from unwanted fluids entering into the unit and/or from unwanted levels of fluid pressure, fluid compositions, and/or fluid flow rates that might damage the unit during positioning from being able to enter into the unit itself.

Further, at various times it may be desirable to shut off the power being generated by assembly 300 for some reason, for example to allow for repair or replacement of one or more components of the units, such as electronics 222, which the assembly remains in place downhole. Assembly 300 is configured such that when it is again desirable to start generating electrical power using the assembly, sleeve 240 may again be repositioned, moving for example in the direction indicated by arrow 246, to a position such as shown in FIG. 3A, wherein the flow restrictor 236 is again extended into the flow of fluid passing through conduit 210, and wherein the first fluid opening 230 and the second fluid opening 232 are again open and in fluid communication with fluid passageway 206, allowing a flow of fluid to pass through the unit, drive impeller 216, and cause generator 220 to generate electrical power.

Figure 4:
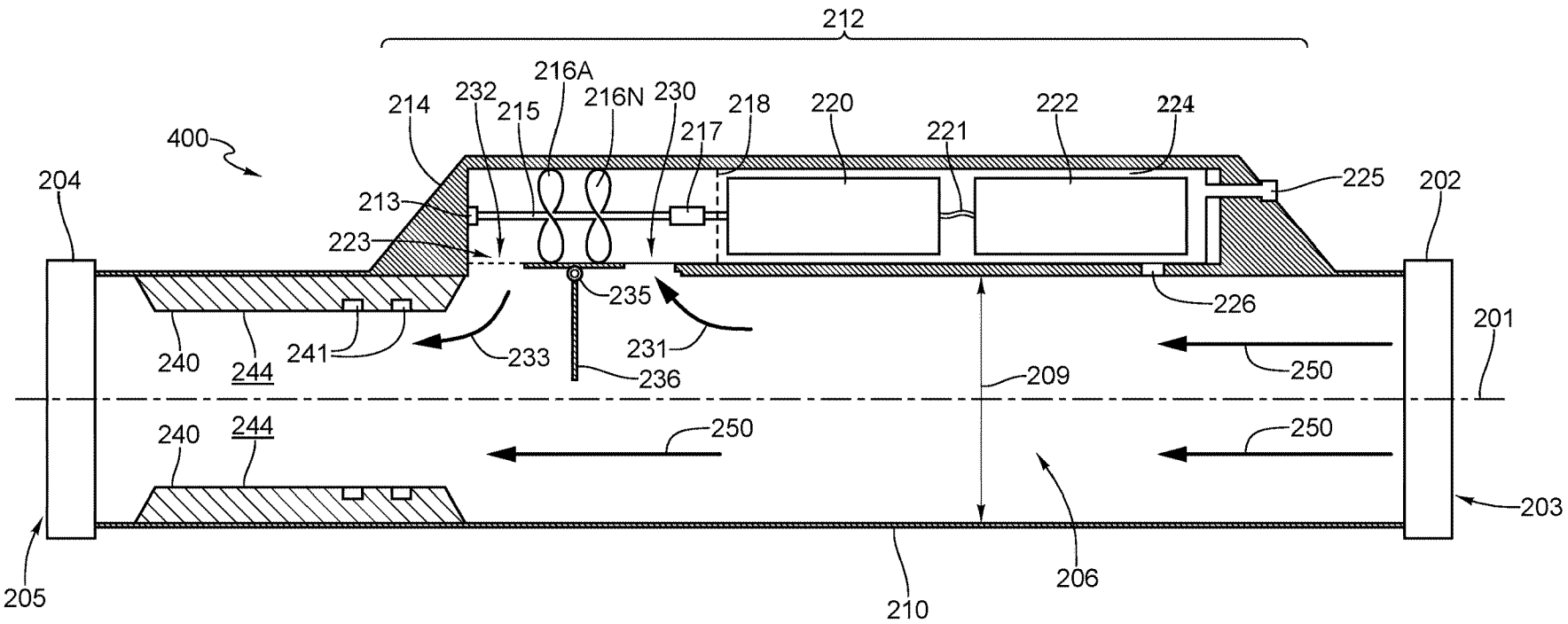
FIG. 4 illustrates a cut-away view of a power generation assembly for downhole tools in accordance with various embodiments.

FIG. 4 illustrates a cut-away view of a power generation assembly 400 for downhole devices in accordance with various embodiments. Like components included in assembly 400 as shown in FIG. 4 and that are the same as and/or perform the same or similar functions as the corresponding parts of assembly 200 (FIGS. 2A-2C) are identified in FIG. 4 with a same reference number.

Assembly 400 (FIG. 4) differs from assembly 200 in that assembly 400 includes multiple impellers located in cavity 223. Fixed diffusers can be added before or after the impellers to achieve additional torque. As shown in FIG. 4, assembly 400 includes a first impeller 216A, and one or more additional impellers, represented as impeller 216N, all of which are attached to shaft 215 and are configured to transfer rotational motion of the impellers to the shaft 215. Advantages of having multiple impellers as shown in FIG. 4 include having more torque coming from the additional blades by using multiple impellers as compared to a single impeller configuration. With a higher torque, a same power level compared to a single impeller configuration could be achieved but with a slower shaft rotational speed. The slower rotational speed allows for less wear on the bearings supporting the impellers and/or the bearing supporting the moving parts within the generator 220. The higher torque makes the design less sensitive to friction at the bearings of some or all of the rotational parts of the assembly.

Other functions of assembly 400, including operation of the flow restrictor 236, sleeve 240, generator 220, and electronics 222 may be the same or similar to those described above with respect to assembly 200 and FIGS. 2A-2C. Further, embodiments of assembly 400 may incorporate the shoulder elements as illustrated and described above with respect to FIGS. 3A-3B, or any variations or equivalents thereof, in a same or similar manner as described with respect to assembly 300.

Figure 5A:
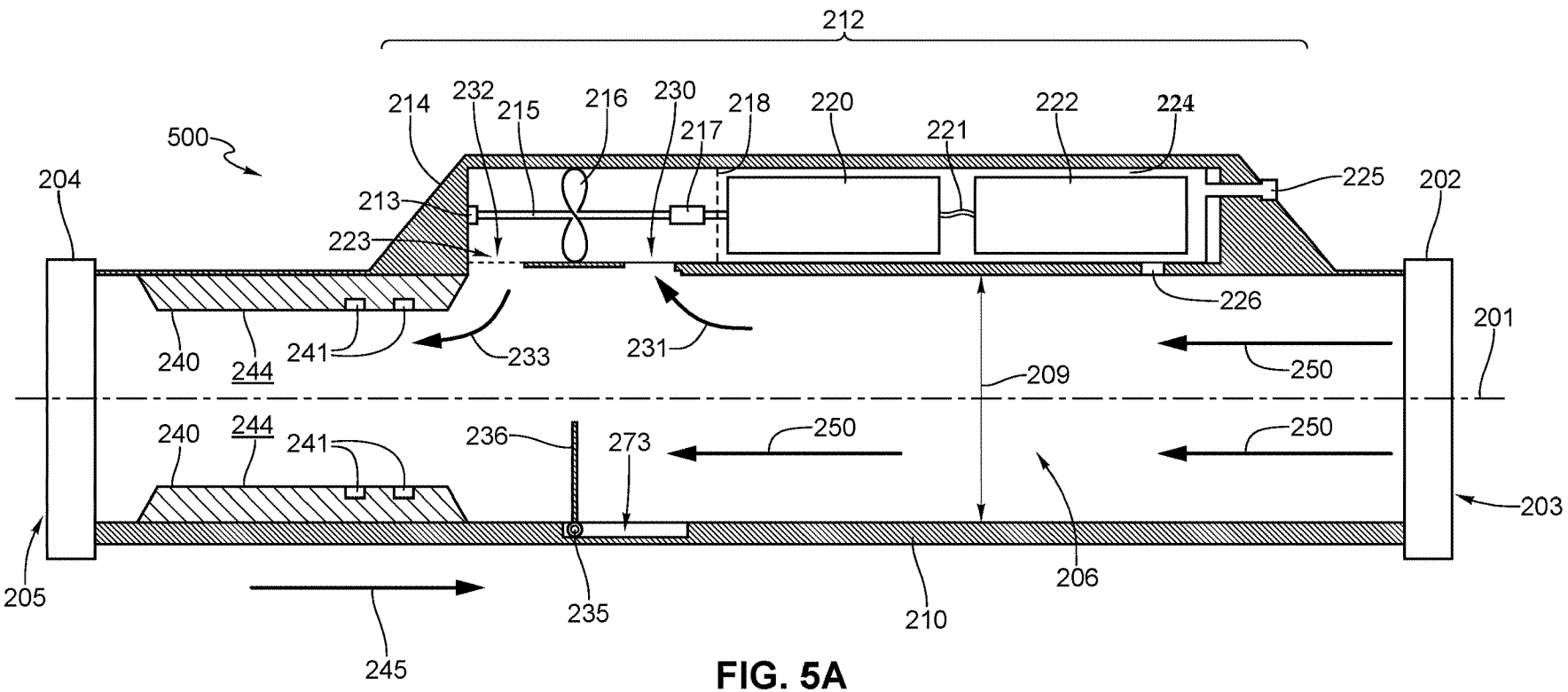
FIG. 5A illustrates a cut-away view of a power generation assembly for downhole tools in accordance with various embodiments.

FIG. 5A illustrates a cut-away view of a power generation assembly 500 for downhole devices in accordance with various embodiments. Like components included in assembly 500 as shown in FIGS. 5A-5B and that are the same as and/or perform the same or similar functions as the corresponding parts of assembly 200 (FIGS. 2A-2C) are identified in FIGS. 5A and 5B with a same reference number.

Assembly 500 (FIGS. 5A, 5B) differs from assembly 200 in that in assembly 500 the flow restrictor 236 is anchored by actuation mechanism 235 at a position that is on an opposite side of fluid passageway 206 from the position where apparatus 212 is located. As shown in FIG. 5A, flow restrictor 236 is anchored by actuation mechanism 235 at one end of recess 273, wherein recess 273 provides a recessed pocket into the inner surface of conduit 210 at a position on the opposite side of fluid passageway 206 from where first opening 230 and second opening 232 are located. The flow restrictor 236 can also be placed at other positions on the ID of the tubing in addition to being opposite the assembly 212. In one embodiment, the flow restrictor 236 is axially collocated within the fluid passageway 206 and is near the midpoint of the fluid passageway 206 in one embodiment. When deployed to be positioned as shown in FIG. 5A, flow restrictor 236 interacts with the flow of fluid through fluid passageway 206, and thereby creates a pressure differential between first opening 230 and second opening 232 of apparatus 212. The pressure differential causes a flow of some of the fluid that is flowing through the fluid passageway 206 to enter first opening 230, to drive impeller 216 in a rotational manner, and exit second opening 232.

Other functions of assembly 500, including operation of the sleeve 240, generator 220, and electronics 222 may be the same or similar to those described above with respect to assembly 200 and FIGS. 2A-2C. Further, embodiments of assembly 500 may incorporate the shoulder elements as illustrated and described above with respect to FIGS. 3A-3B, or any variations or equivalents thereof, in a same or similar manner as described with respect to assembly 300. As shown in FIG. 5A, the radial positioning of the flow restrictor 236 is not limited to being positioned directly opposite the position of first opening 230 and second opening 232 within conduit 210, wherein flow restrictor 236 may be position at other radial positions around longitudinal axis 201 as long as when deployed as shown in FIG. 5A, the flow restrictor is capable of interacting with the flow of fluid passing through fluid passageway 206 in a manner that generates a pressure differential between first opening 230 and second opening 232.

Figure 5B:
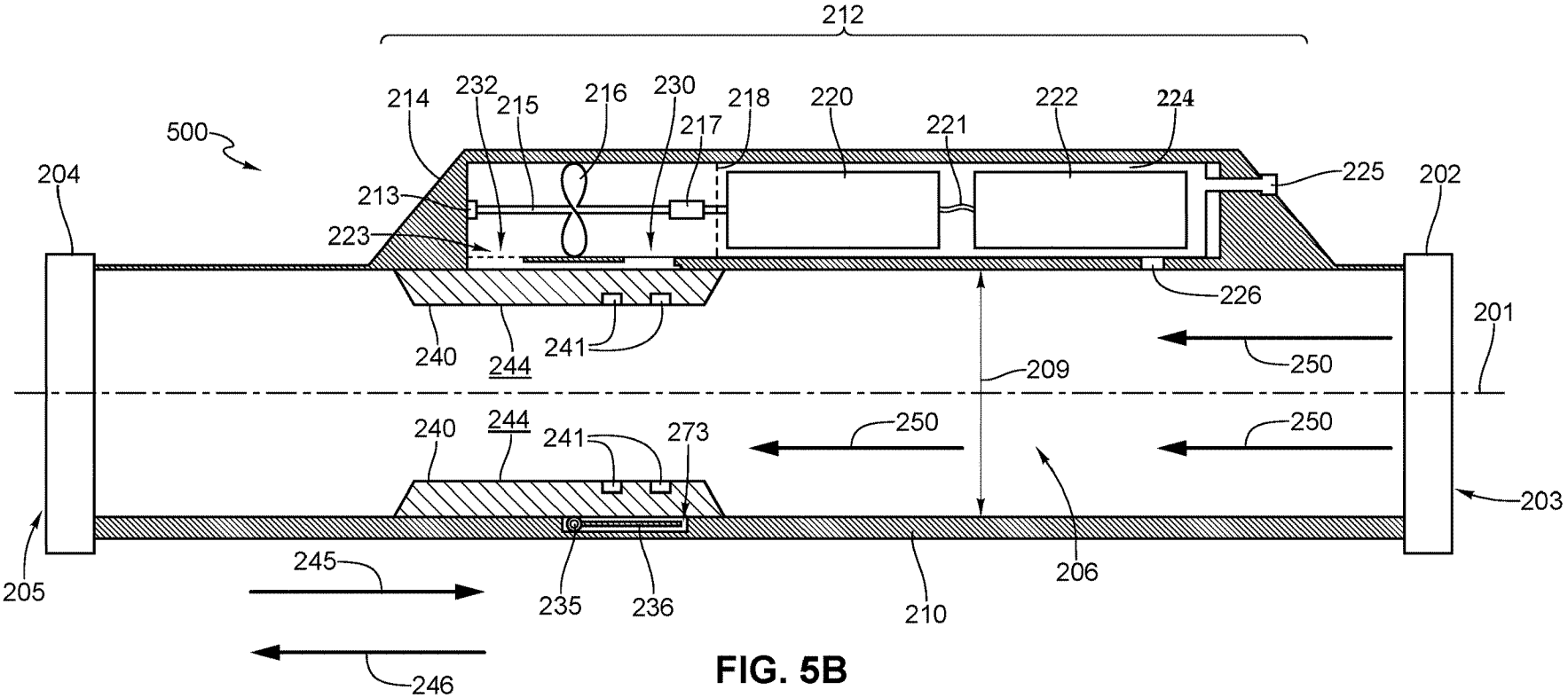
FIG. 5B illustrates a cut-away view of the power generation assembly of FIG. 5A when configured in an idle configuration, in accordance with various embodiments.

FIG. 5B illustrates a cut-away view of the power generation assembly 500 of FIG. 5A when configured in an idle configuration, in accordance with various embodiments. As shown in FIG. 5B, sleeve 240 has been repositioned along longitudinal axis 201 in a direction indicated by arrow 245.

When positioned as shown in FIG. 5B, sleeve 240 covers over both the first fluid opening 230 and the second fluid opening 232 of the power generation unit. In addition, when positioned as shown in FIG. 3B, sleeve 240 holds the flow restrictor 236 in a retracted position, in various embodiments in a position so that the flow restrictor 236 extend from the actuation mechanism 235 in a direction parallel to longitudinal axis 201, and on the opposite side of sleeve 240 from the inner surface 244 of the sleeve and in recess 273. As such, flow restrictor 236 is separated from contact with any fluid flow (represented by arrow 250) that may be flowing through fluid passageway 206. In addition, any flow of fluid present in fluid passageway 206 is preventing from entering into and/or from exiting first fluid opening 230 and second fluid opening 232 of the power generation unit. When configured as shown in FIG. 5B, no electrical power is being generated by assembly 500 even if there is a flow of fluid through fluid passageway 206.

In various embodiments, power generation assembly 500 would be configured as shown in FIG. 5B during times when the assembly is coupled with additional tubing, pipes, and/or casing but is being positioned, i.e., moved along, within a wellbore before being located at a desired location within the wellbore, or when it is desirable to shut off the power being generated by assembly 500 for some reason, as described above for example with respect to the operation of assembly 200 (FIGS. 2A-2C) or 300 (FIGS. 3A-3B). In various embodiments, assembly 500 is configured such that when it is again desirable to start generating electrical power using the assembly, sleeve 240 may again be repositioned, moving for example in the direction indicated by arrow 246 to a position such as shown in FIG. 5A, wherein the flow restrictor 236 is again extended into the flow of fluid passing through conduit 210, and wherein the first fluid opening 230 and the second fluid opening 232 are again open and in fluid communication with fluid passageway 206, allowing a flow of fluid to pass through apparatus 212, drive impeller 216, and cause generator 220 to generate electrical power.

Figure 6A:
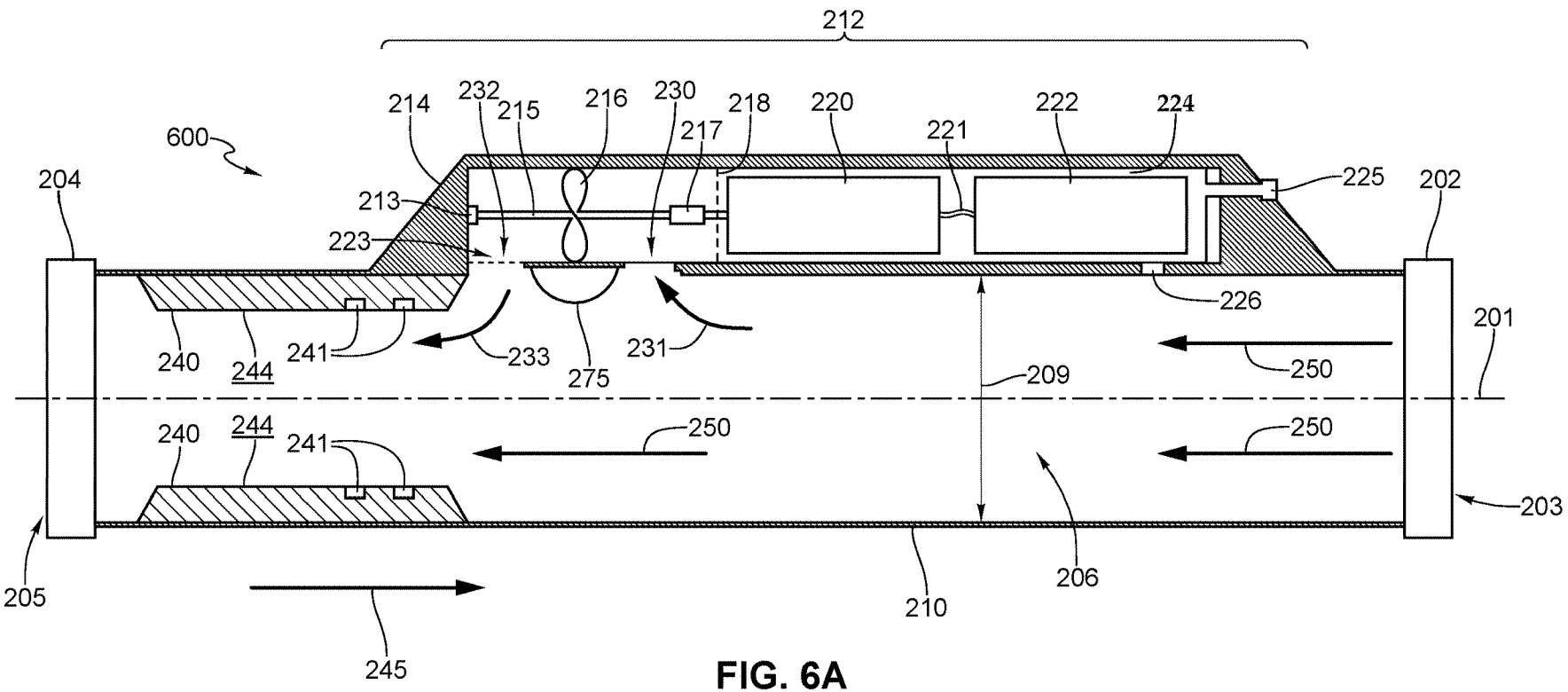
FIG. 6A illustrates a cut-away view of a power generation assembly for downhole tools in accordance with various embodiments.

FIG. 6A illustrates a cut-away view of a power generation assembly 600 for downhole devices in accordance with various embodiments. Like components included in assembly 600 as shown in FIGS. 6A-6B and that are the same as and/or perform the same or similar functions as the corresponding parts of assembly 200 (FIGS. 2A-2C) are identified in FIGS. 6A and 6B with a same reference number.

Assembly 600 (FIGS. 6A, 6B) differs from assembly 200 in that in assembly 600 the flow restrictor 275, instead of having a flat plate shape, comprises an arch shape that is anchored at a first end and at a second end to the portion of the body of the apparatus 212 between the first opening 230 and the second opening 232, and having a middle portion that extends out away from the body of the apparatus 212 so as to interact with any fluid that is flowing through the fluid passageway 206. In various embodiments, flow restrictor 275 is a layer of material having a spring like characteristic, such as a leaf spring, which pushes the middle portion of the flow restrictor outward to extend into the fluid passageway 206 when not otherwise constrained for example by sleeve 240. In another embodiment, the arch shape is created from a two-body structure created with a hinge or flexure. The interaction of the flow restrictor 275 with a flow of fluid that is flowing through fluid passageway 206 when the flow restrictor is deployed to extend outward into the fluid passageway 206 causes a pressure differential to be generated between the first opening 230 and the second opening 232.

The pressure differential between the first opening 230 and the second opening 232 causes some of the fluid that is flowing through the fluid passageway 206 to enter first opening 230, to drive impeller 216 in a rotational manner, and to exit second opening 232. Other functions of assembly 600, including operation of the sleeve 240, generator 220, and electronics 222 may be the same or similar to those described above with respect to assembly 200 and FIGS. 2A-2C. Further, embodiments of assembly 600 may incorporate the shoulder elements as illustrated and described above with respect to FIGS. 3A-3B, or any variations or equivalents thereof, in a same or similar manner as described with respect to assembly 300. The radial positioning of the flow restrictor 275 is not limited to being positioned directly on the body of apparatus 212 between first opening 230 and second opening 232, wherein flow restrictor 275 may be position at other radial position around longitudinal axis 201 as long as when deployed as shown in FIG. 6A, the flow restrictor is capable of interacting with the flow of fluid passing through fluid passageway 206 in a manner that generates a pressure differential between first opening 230 and second opening 232.

Figure 6B:
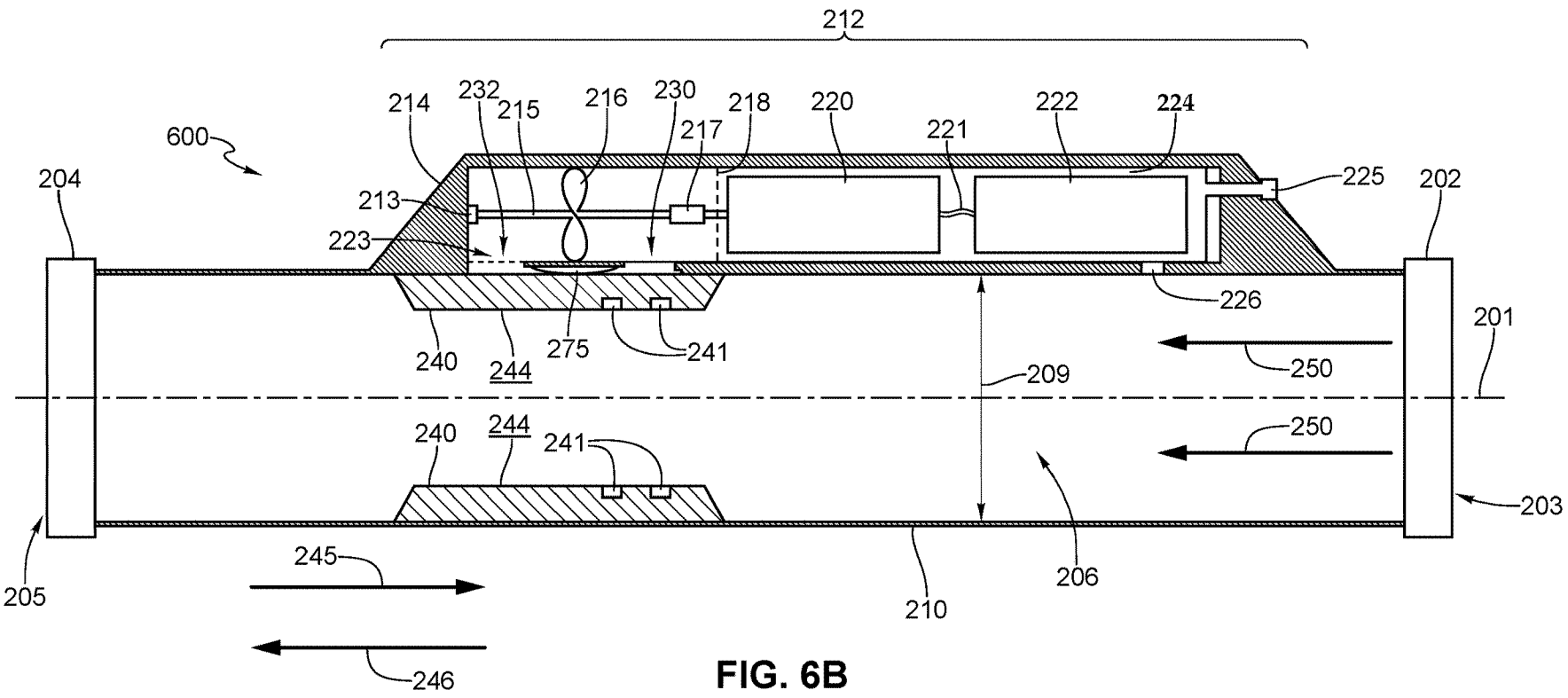
FIG. 6B illustrates a cut-away view of the power generation assembly of FIG. 6A when configured in an idle configuration, in accordance with various embodiments.

FIG. 6B illustrates a cut-away view of the power generation assembly 600 of FIG. 6A when configured in an idle configuration, in accordance with various embodiments. As shown in FIG. 6B, sleeve 240 has been repositioned along longitudinal axis 201 in a direction indicated by arrow 245. When positioned as shown in FIG. 6B, sleeve 240 covers over both the first fluid opening 230 and the second fluid opening 232 of the power generation unit. In addition, when positioned as shown in FIG. 6B, sleeve 240 holds the flow restrictor 275 in a collapsed and retracted position, in various embodiments in a position so that the flow restrictor 275 no longer extends out into fluid passageway 206, and is positioned on the side of sleeve 240 opposite the inner surface 244 of the sleeve. As such, flow restrictor 275 is separated from contact with any fluid flow (represented by arrows 250) that may be flowing through fluid passageway 206. In addition, any flow of fluid present in fluid passageway 206 is preventing from entering into and/or from exiting first fluid opening 230 and second fluid opening 232 of the power generation unit.

When configured as shown in FIG. 6B, no electrical power is being generated by assembly 600 even if there is a flow of fluid through fluid passageway 206. As described above with respect to other power generation assemblies, power generation assembly 600 would be configured as shown in FIG. 6B during times when the assembly is coupled with additional tubing, pipes, and/or casing but is being positioned, i.e., moved along, within a wellbore before being located at a desired location within the wellbore, or when it is desirable to shut off the power being generated by assembly 600 for some reason, as described above for example with respect to the operation of assembly 200 (FIGS. 2A-2C) or 300 (FIGS. 3A-3B). In various embodiments, assembly 600 is configured such that when it is again desirable to start generating electrical power using the assembly, sleeve 240 may again be repositioned, moving for example in the direction indicated by arrow 246 to a position such as shown in FIG. 6A, wherein the flow restrictor 275 is again extended into the flow of fluid passing through conduit 210, and wherein the first fluid opening 230 and the second fluid opening 232 are again open and in fluid communication with fluid passageway 206, allowing a flow of fluid to pass through the unit, to drive impeller 216, and to cause generator 220 to generate electrical power. Embodiments of power generation assembly 600 are not limited to utilizing only a single impeller within cavity 223, and may include a multiple impellers as illustrated and describe above with respect to FIG. 4.

Figure 7A:
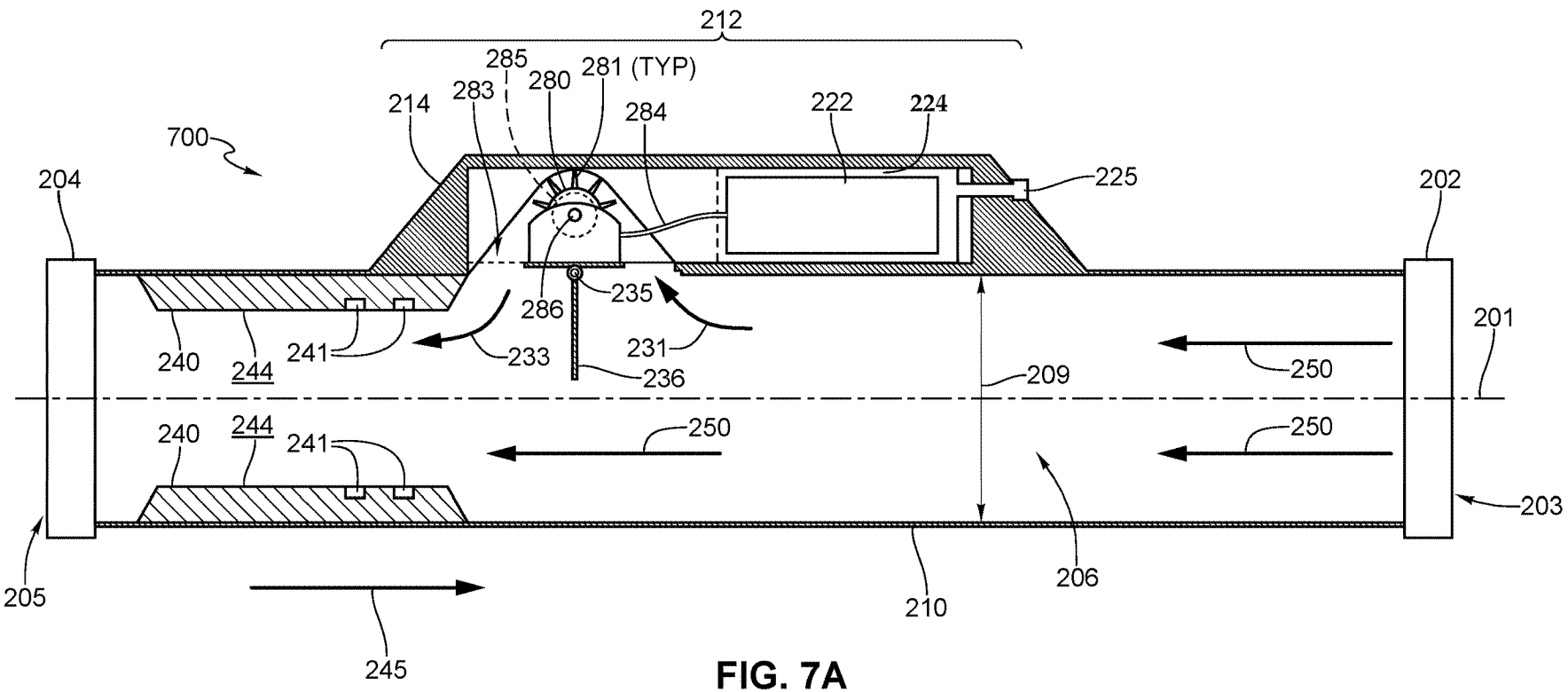
FIG. 7A illustrates a cut-away view of a power generation assembly for downhole tools in accordance with various embodiments.
Figure 7B:
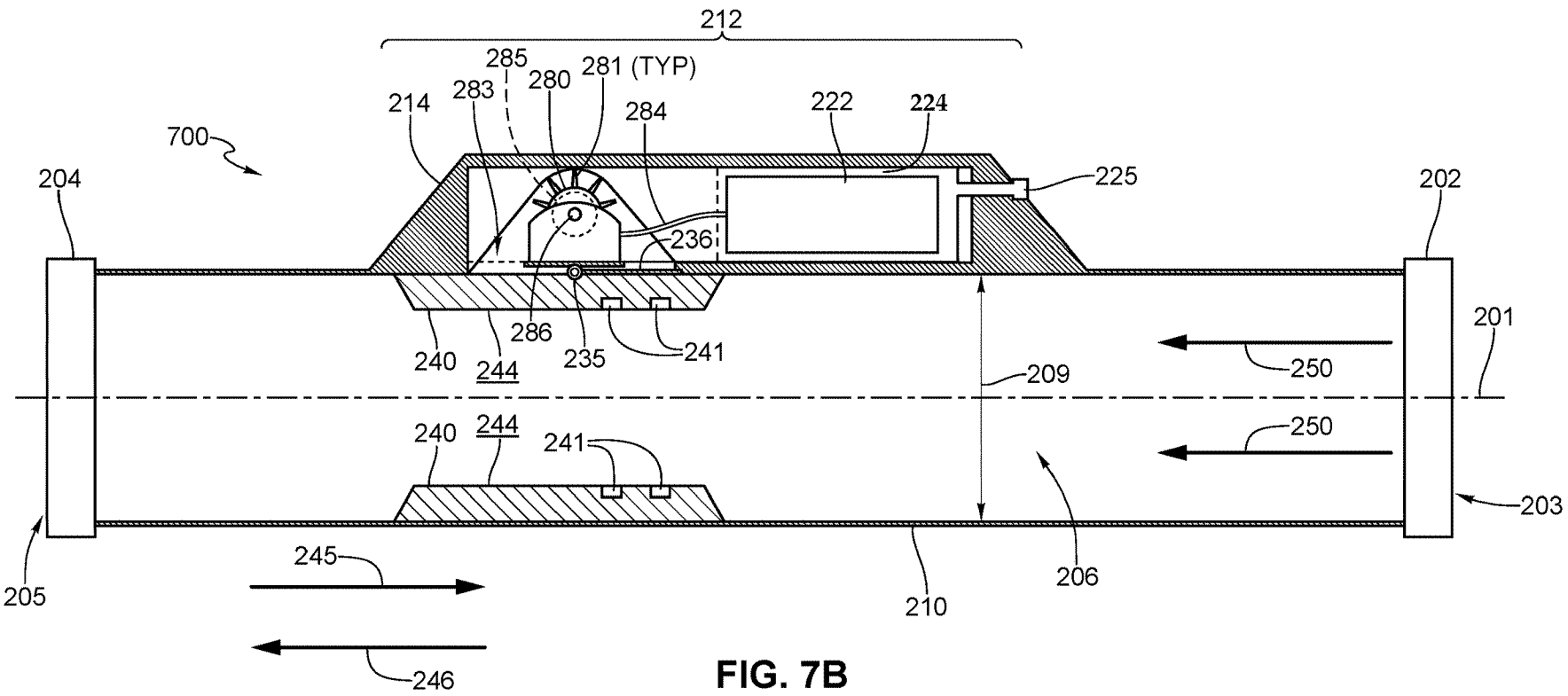
FIG. 7B illustrates a cut-away view of the power generation assembly of FIG. 7A when configured in an idle configuration, in accordance with various embodiments.

FIG. 7A illustrates a cut-away view of a power generation assembly 700 for downhole devices, in accordance with various embodiments. Like components included in assembly 700 as shown in FIGS. 7A-7B and that are the same as and/or perform the same or similar functions as the corresponding parts of assembly 200 (FIGS. 2A-2C) are identified in FIGS. 7A and 7B with a same reference number.

Assembly 700 (FIGS. 7A, 7B) differs from assembly 200 in that assembly 700 utilized a transverse drive mechanism positioned within cavity 223 that incorporates a built-in electrical generator, the transverse drive mechanism comprising a rotary wheel 280 having a plurality of impeller blades 281 coupled around an outer perimeter of the rotary wheel, and having the impeller blades 281 positioned in a flow path 283 that extends between the first opening 230 and the second opening 232. An axel 286 that the rotary wheel 280 is mounted to and which the rotary wheel rotates around has a longitudinal axis that is orthogonal to the longitudinal axis 201.

Flow restrictor 236, when extended as shown in FIG. 7A, generates the pressure differential between a first opening to flow path 283, represented by arrow 231, and second opening from flow path 283, represented by arrow 233, when fluid is flowing through fluid passageway 206, as described above with respect to other assemblies. For assembly 700, the pressure differential generated between the first opening and the second opening causes a portion of the fluid flowing through fluid passageway 206 to flow into the first opening, interact with impeller blades 281, and exit out of the second opening, and in the process interacting with blades 281 causing rotation of rotary wheel 280. The rotation of rotary wheel 280 rotates some portion of the built-in electrical generator 285, causing the electrical generator to generate electrical power, which is transferred to electronics 222 through electrical connection 284. For example, embodiment of the electrical generator would include permanent magnets located in the rotor or rotating portion of the electrical generator, and a stator would contain the coils for power generation. Using this arrangement including a built-in electrical generator eliminates the mechanical linkages that would normally be needed between the impeller/driver mechanism and a separate electrical generator that would be driven by the impeller or driver mechanism.

Other functions of assembly 700, including operation of the sleeve 240 and electronics 222 may be the same or similar to those described above with respect to assembly 200 and FIGS. 2A-2C. Further, embodiments of assembly 700 may incorporate the shoulder elements as illustrated and described above with respect to FIGS. 3A-3B, or any variations or equivalents thereof, in a same or similar manner as described with respect to assembly 300. Advantages of using the traverse drive as described above and illustrated with respect to assembly 700 of FIG. 7A-7B include providing more power output at lower flow velocities and higher differential pressures.

FIG. 7B illustrates a cut-away view of the power generation assembly 700 of FIG. 7A when configured in an idle configuration, in accordance with various embodiments. As shown in FIG. 7B, sleeve 240 has been repositioned along longitudinal axis 201 in a direction indicated by arrow 245. When positioned as shown in FIG. 7B, sleeve 240 covers over both the first fluid opening and the second fluid opening of the flow path 283 of the power generation unit, thereby sealing off both the entrance and the exit of the flow path. In addition, when positioned as shown in FIG. 7B, sleeve 240 holds the flow restrictor 236 in a retracted position, in various embodiments in a position so that the flow restrictor 236 no longer extends out into fluid passageway 206, and is positioned on the side of sleeve 240 opposite the inner surface 244 of the sleeve. As such, flow restrictor 236 is separated from contact with any fluid flow (represented by arrows 250) that may be flowing through fluid passageway 206. When configured as shown in FIG. 7B, no electrical power is being generated by assembly 700 even if there is a flow of fluid through fluid passageway 206.

As described above with respect to other power generation assemblies, power generation assembly 700 would be configured as shown in FIG. 7B during times when the assembly is coupled with additional tubing, pipes, and/or casing but is being positioned, i.e., moved along, within a wellbore before being located at a desired location within the wellbore, or when it is desirable to shut off the power being generated by assembly 700 for some reason, as described above for example with respect to the operation of assembly 200 (FIGS. 2A-2C) or 300 (FIGS. 3A-3B). In various embodiments, assembly 700 as shown in FIG. 7B is configured such that when it is again desirable to start generating electrical power using the assembly, sleeve 240 may again be repositioned, moving for example in the direction indicated by arrow 246 to a position such as shown in FIG. 7A, wherein the flow restrictor 236 is again extended into the flow of fluid passing through conduit 210, and wherein the first fluid opening and the second fluid opening of flow path 283 are again open and in fluid communication with fluid passageway 206, allowing a flow of fluid to pass through the flow path 283, which in turn drives rotary wheel 280, and in turn causes generator 220 to generate electrical power.

Figure 8:
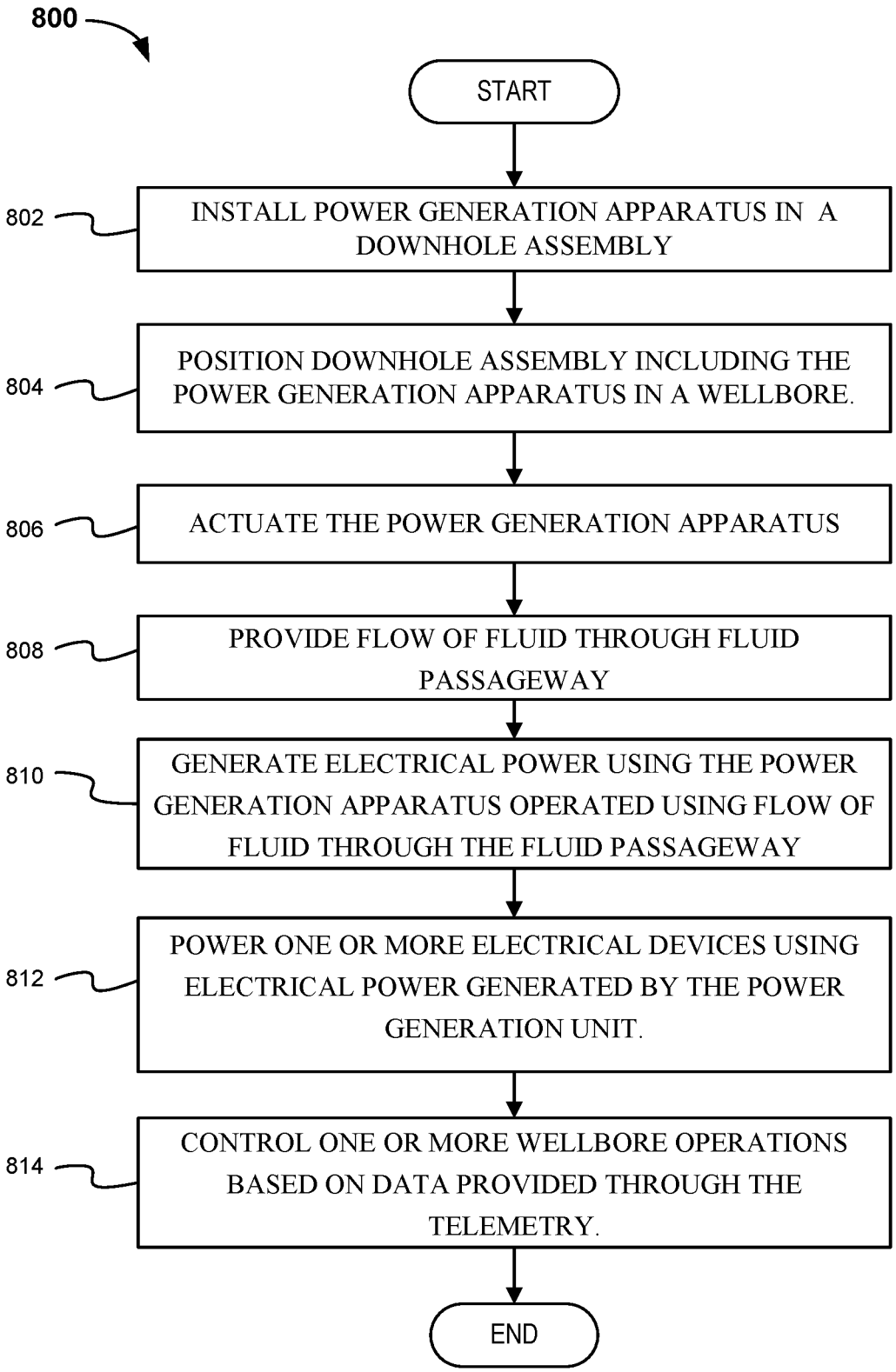
FIG. 8 illustrates a flowchart of a method according to various embodiments.

FIG. 8 illustrates a flowchart of a method 800 according to various embodiments. In various embodiments, method 800 may be performed by some combination of the components illustrated and described above with respect to well system 100 and FIG. 1A and/or well system 160 and FIG. 1B. In various embodiments, method 800 may be performed including the use of one or more embodiments of the power generation assemblies as described throughout this disclosure to provide self-contained electrical power generation capabilities for use in wellbore environments, including for using in electrically powering and performing communication functions with devices located downhole within a wellbore.

As shown in FIG. 8, embodiments of method 800 include installing a power generation apparatus in a section of a downhole assembly, such as a conduit or downhole device (block 802).

Embodiments of method 800 include positioning the downhole conduit or device including the power generation apparatus into a wellbore (block 804). Positioning the downhole conduit or device including the power generation apparatus includes performing the positioning while the power generation apparatus is configured in a non-deployed configuration, having the flow restrictor in a retracted and/or covered configuration, and wherein the opening to the cavity where the impellers or other drive mechanism devices are located are closed, for example by the positioning of a movable sleeve over the openings.

Embodiments of method 800 include actuating the power generation apparatus (block 806). In various embodiments, actuating the power generation apparatus includes extending a flow restrictor from a retracted or covered position to a position where the flow restrictor will engage a fluid flow through fluid passageway. Actuation of the power generation apparatus further includes opening the fluid openings of the power generation apparatus so that the openings are in fluid communication with the fluid flow passing through the fluid passageway. Actuation of both the flow restrictor and the opening of the fluid opening of the power generation apparatus may involve moving a sleeve to a position wherein the sleeve no longer retains the flow restrictor in the retracted or covered position, allowing an actuation mechanism coupled to the flow restrictor to extend the flow restrictor, and also to uncover the fluid openings in the power generation apparatus.

Embodiments of method 800 include providing a flow of fluid through the fluid passageway where the flow restrictor has been extended (block 808). The flow of fluid may comprise a drilling fluid in drilling operations. The flow of fluid may comprise a production fluid in operations involving production of underground hydrocarbons or other subterranean resources.

Embodiments of method 800 include generating electrical power using the power generation apparatus operated using the flow of fluid through the fluid passageway (block 810).

Embodiments of method 800 include powering one or more electrical devices using the electrical power generated by the power generation apparatus (block 812). In various embodiments, the one or more electrical devices include sensors. In various embodiments, the one or more electrical devices include data logging devices. In various embodiments, the one or more electrical devices include telemetry and communication devices. In various embodiments, the one or more electrical devices are built into the power generation apparatus that is supplying the electrical power to the one or more electrical devices. In various embodiments, at least one of the one or more electrical devices being powered by the electrical power generated by the power generation apparatus that located outside of the power generation apparatus.

Embodiments of method 800 include controlling one or more wellbore operations based on the data provided through the telemetry (block 814). Controlling one or more wellbore operation may include any control needed during a drilling operation, such as controlling weight-on-bit, rate of drill bit rotation, flow rate and/or composition of the drilling fluid being provided to the drill bit. Controlling one or more wellbore operation as part of a production operation may include any control related to the pumping, operation of packers, or other control operations needed to provide proper and safe production at the wellbore.

FIG. 9 illustrates a block diagram of an example computer system 900 that may be employed to practice the concepts, methods, and techniques as disclosed herein, and variations thereof. Computing system 900 includes a plurality of components of the system that are in electrical communication with each other, in some examples using a bus 903. Embodiments of computing system 900 may include any suitable computer, controller, or data processing apparatus capable of being programmed to carry out the methods and for controlling apparatus as further described herein. In various embodiments, one or more components illustrated and described with respect to computing system 900 may be included in one or more of power generation assemblies 126, 127, 128, and controller 115 as illustrated and described above with respect to FIG. 1A. In various embodiments, one or more components illustrated and described with respect to computing system 900 may be included in one or more of power generation assemblies 190, 192 and in a bottom hole assembly, such as BHA 164, or otherwise configured to be positioned downhole within a wellbore, as described above with respect to FIG. 1B.

Referring back to FIG. 9, computing system 900 may be a general-purpose computer, and includes a processor 901 (possibly including multiple processors, multiple cores, multiple nodes, and/or implementing multi-threading, etc.). The computer system 900 includes memory 902. The memory 902 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media configured to store data and/or program instructions in an electronic format. The computer system also includes the bus 903 (e.g., PCI, ISA, PCI-Express, HyperTransport® bus, InfiniBand® bus, NuBus, etc.) and a network interface 905 (e.g., a Fiber Channel interface, an Ethernet interface, an internet small computer system interface, SONET interface, wireless interface, etc.). Bus 903 may be configured to provide communications between any of the devices included in computing system 900. As illustrated in FIG. 9, the processor 901 and the network interface 905 are coupled to the bus 903. Although illustrated as also being coupled to the bus 903, the memory 902 may be coupled to the processor 901 only, or both processor 901 and bus 903. In some examples, memory 902 includes non-volatile memory and can be a hard disk or other types of computer readable media which can store data and program instructions that are accessible by a computer, such as magnetic cassettes, flash memory cards, solid state memory devices, digital versatile disks (DVDs), cartridges, RAM, ROM, a cable containing a bit stream, and hybrids thereof. Network interface 905 may be configured to provide communications between computing system 900 and other computing devices.

Embodiments of computer system 900 include electrical devices 908. Electrical devices 908 may receive electrical power used to operate the electrical devices that is generated by one or more electrical power generation apparatus 920, such as any of the power generation apparatus as described throughout this disclosure. The electrical devices 908 may include devices such as sensors configured to sense one or more physical parameters associated with downhole condition where the sensors are located. Electrical devices 908 may include electrical devices and circuitry configured to provide communication signal outputs, for example through network interface 905, and to receive and process communication signals that may be received at network interface 905. The electrical power required to operate these communication circuitry may be generated by one of more of the power generation apparatus 920 as described throughout this disclosure.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 900 or as a general purpose computer, some embodiments can be any type of device or apparatus to perform operations described herein.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

While the aspects of the disclosure are described with reference to various implementations and exploitations, it will be understood that these aspects are illustrative and that the scope of the claims is not limited to them. In general, techniques for generating electrical power using the self-contained power generation assemblies as described herein may be implemented with facilities consistent with any hardware system or hardware/software systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. An apparatus comprising: an electrical power generation apparatus configured to generate electrical power using a flow of fluid flowing through a fluid passageway of a conduit configured as part of a wellbore tubing, the electrical power generation apparatus comprising: an flow restrictor configured to be deployable to extend into the conduit and interact with a flow of fluid passing through the fluid passageway, the flow restrictor configured to generate a pressure differential between a first opening and a second opening that are both in fluid communication with the fluid passageway and a cavity within the electrical power generation apparatus; and a mechanical drive mechanism positioned within the cavity and coupled to an electrical generator, the mechanical drive mechanism configured to convert a flow of fluid passing through the cavity into a mechanical rotational movement of an input shaft coupled to the electrical generator, the electrical generator configured to generate electrical power when the input shaft of the electrical generator is rotated by the mechanical drive mechanism.

Embodiment 2. The apparatus of embodiment 1, further comprising: a sleeve that is position within the conduit, the sleeve moveable along a longitudinal axis of the conduit between a first position and a second position, wherein when in the first position the sleeve is configured to hold the flow restrictor in a retracted position such that the flow restrictor is not extended into the fluid passageway, and wherein when in the second position the sleeve is configured to allow the flow restrictor to extend into the fluid passageway and to interact with a flow of fluid that is flowing through the fluid passageway.

Embodiment 3. The apparatus of embodiment 2, further comprising: a set of shoulder elements positioned within the conduit and encircling the longitudinal axis of the conduit, each of the shoulder elements having an inner surface facing toward that longitudinal axis at a same distance radially from the longitudinal axis as an inner surface of the sleeve that faces the longitudinal axis.

Embodiment 4. The apparatus of any one of embodiments 1 to 3, wherein the flow restrictor comprise a flat sheet of material that is rotatably coupled to the electrical power generation apparatus by an articulation mechanism configured to urge the flow restrictor into a position wherein the flow restrictor extends outward from the electrical power generation apparatus and into the fluid passageway of the conduit.

Embodiment 5. The apparatus of any one of embodiments 1 to 3, wherein the flow restrictor comprises an arch shaped sheet of material having a first end and a second end coupled to the electrical power generation apparatus and a middle section extending between the first end and the second end, the middle section configured to extend outward from the electrical power generation apparatus and into the fluid passageway of the conduit when the flow restrictor is in a deployed configuration.

Embodiment 6. The apparatus of any one of embodiments 1 to 5, wherein the mechanical drive mechanism includes a single impeller coupled to the input shaft of the electrical generator.

Embodiment 7. The apparatus of any one of embodiments 1 to 5, wherein the mechanical drive mechanism includes a plurality of individual impellers, each of the plurality of individual impellers spaced apart from one another along the input shaft of the electrical generator.

Embodiment 8. The apparatus of any one of embodiments 1 to 7, further comprising: one or more electrical devices included within the electrical power generation apparatus, the one or more electrical devices electrically coupled to an electrical output of the electrical generator and configured to operate using electrical power provide by the electrical generator.

Embodiment 9. The apparatus of any one of embodiments 1 to 8, wherein the electrical power provided by the electrical generator is a direct current.

Embodiment 10. The apparatus of any one of embodiments 1 to 9, wherein the flow of fluid flowing through the fluid passageway of the conduit comprises production fluid being extracted from the wellbore through the conduit.

Embodiment 11. The apparatus of any one of embodiments 1 to 9, wherein the flow of fluid flowing through the fluid passageway of the conduit comprises drilling fluid.

Embodiment 12. An apparatus comprising: an electrical power generation apparatus configured to generate electrical power using a flow of fluid flowing through a fluid passageway of a conduit configured as part of a wellbore tubing, the electrical power generation apparatus comprising: a flow restrictor configured to be deployable to extend into the conduit and interact with a flow of fluid passing through the fluid passageway, the flow restrictor configured to generate a pressure differential between a first opening and a second opening that are both in fluid communication with the fluid passageway and a cavity within the electrical power generation apparatus; and a mechanical drive mechanism positioned within the cavity and incorporating an electrical generator as part of the mechanical drive mechanism, the mechanical drive mechanism configured as a transverse drive mechanism having a transverse drive axel that is oriented orthogonally to a longitudinal axis of the conduit, the mechanical drive mechanism configured to convert a flow of fluid passing through the cavity into a mechanical rotational movement of the electrical generator to generate electrical power when the electrical generator is being rotated by the flow of fluid passing through the cavity.

Embodiment 13. The apparatus of embodiment 12, wherein the mechanical drive mechanism includes a rotary wheel having a plurality of blades arranges around an outer circumference of the rotary wheel, the plurality of blades configured to interact with the flow of fluid passing through the cavity and thereby rotating the rotary wheel and rotating some portion of the electrical generator that is coupled to the rotary wheel and thereby causing the electrical generator to generate electrical power.

Embodiment 14. The apparatus of embodiment 13, wherein a subset of the plurality of blades are positioned along a flow path extending through the cavity regardless of the rotational positioning of the rotary wheel, and wherein the flow path is configured to accommodate a flow of fluid between the first opening and the second opening of the electrical power generation apparatus, thereby interacting with the subset of the plurality of blades positioned along the flow path.

Embodiment 15. The apparatus of any one of embodiments 12 to 14, further comprising: a sleeve that is positioned within the conduit, the sleeve moveable along a longitudinal axis of the conduit between a first position and a second position, wherein when in the first position the sleeve is configured to hold the flow restrictor in a retracted position such that the flow restrictor is not extended into the fluid passageway, and wherein when in the second position the sleeve is configured to allow the flow restrictor to extend into the fluid passageway and to interact with a flow of fluid that is flowing through the fluid passageway.

Embodiment 16. The apparatus of embodiment 15, further comprising: a set of shoulder elements positioned within the conduit and encircling the longitudinal axis of the conduit, each of the shoulder elements having an inner surface facing toward the longitudinal axis at a same distance radially from the longitudinal axis as an inner surface of the sleeve that faces the longitudinal axis.

Embodiment 17. The apparatus of any one of embodiment 12 to 16, further comprising: one or more electrical devices included within the electrical power generation apparatus, the one or more electrical devices electrically coupled to an electrical output of the electrical generator and configured to operate using electrical power provide by the electrical generator.

Embodiment 18. A method comprising: positioning an electrical power generation apparatus at a location within a wellbore, the electrical power generation apparatus including a conduit having a fluid passageway extending through the conduit that is configured to accommodate a flow of fluid through the conduit, the electrical power generation apparatus comprising: an flow restrictor configured to be deployable to extend into the conduit and interact with the flow of fluid passing through the fluid passageway, a flow restrictor configured to generate a pressure differential between a first opening and a second opening that are both in fluid communication with the fluid passageway and a cavity within the electrical power generation apparatus, and a mechanical drive mechanism positioned within the cavity and coupled to an electrical generator, the mechanical drive mechanism configured to convert a flow of fluid passing through the cavity into a mechanical rotational movement coupled to the electrical generator, the electrical generator configured to generate electrical power when some portion of the electrical generator is rotated by the mechanical drive mechanism; extending the flow restrictor from a retracted or covered position to a position where the flow restrictor will engage a fluid flow through fluid passageway; providing the flow of fluid through the fluid passageway where the flow restrictor has been extended; and generating electrical power using the flow of fluid to operate the mechanical drive mechanism and thereby the input shaft of the electrical generator.

Embodiment 19. The method of embodiment 18, wherein extending the flow restrictor includes moving a sleeve that is positioned within the conduit and that is moveable along a longitudinal axis of the conduit from a first position to a second position, wherein when in the first position the sleeve is holding the flow restrictor in a retracted position such that the flow restrictor is not extended into the fluid passageway, and wherein when in the second position the sleeve is positioned away from the flow restrictor, allowing the flow restrictor to extend into the fluid passageway and to interact with the flow of fluid that is flowing through the fluid passageway.

Embodiment 20. The method of one of embodiments 18 or 19, further comprising: electrically powering one or more electrical devices included within the electrical power generation apparatus using the electrical power being generated by the electrical generator.

What is claimed is:

1. An apparatus comprising:

an electrical power generation apparatus configured to generate electrical power using a flow of fluid flowing through a fluid passageway of a conduit configured as part of a wellbore tubing, the electrical power generation apparatus comprising:

a flow restrictor configured to be deployable to extend into the conduit and interact with a flow of fluid passing through the fluid passageway, the flow restrictor configured to generate a pressure differential between a first opening and a second opening that are both in fluid communication with the fluid passageway and a cavity within the electrical power generation apparatus;

a sleeve that is position within the conduit, the sleeve moveable along a longitudinal axis of the conduit between a first position and a second position, wherein when in the first position the sleeve is configured to hold the flow restrictor in a retracted position such that the flow restrictor is not extended into the fluid passageway, and wherein when in the second position the sleeve is configured to allow the flow restrictor to extend into the fluid passageway and to interact with a flow of fluid that is flowing through the fluid passageway; and a mechanical drive mechanism positioned within the cavity and coupled to an electrical generator, the mechanical drive mechanism configured to convert a flow of fluid passing through the cavity into a mechanical rotational movement of an input shaft coupled to the electrical generator, the electrical generator configured to generate electrical power when the input shaft of the electrical generator is rotated by the mechanical drive mechanism.

2. The apparatus of claim 1, further comprising:

a set of shoulder elements positioned within the conduit and encircling the longitudinal axis of the conduit, each of the shoulder elements having an inner surface facing toward that longitudinal axis at a same distance radially from the longitudinal axis as an inner surface of the sleeve that faces the longitudinal axis.

3. The apparatus of claim 1, wherein the flow restrictor comprise a flat sheet of material that is rotatably coupled to the electrical power generation apparatus by an articulation mechanism configured to urge the flow restrictor into a position wherein the flow restrictor extends outward from the electrical power generation apparatus and into the fluid passageway of the conduit.

4. The apparatus of claim 1, wherein the flow restrictor comprises an arch shaped sheet of material having a first end and a second end coupled to the electrical power generation apparatus and a middle section extending between the first end and the second end, the middle section configured to extend outward from the electrical power generation apparatus and into the fluid passageway of the conduit when the flow restrictor is in a deployed configuration.

5. The apparatus of claim 1, wherein the mechanical drive mechanism includes a single impeller coupled to the input shaft of the electrical generator.

6. The apparatus of claim 1, wherein the mechanical drive mechanism includes a plurality of individual impellers, each of the plurality of individual impellers spaced apart from one another along the input shaft of the electrical generator.

7. The apparatus of claim 1, further comprising:

one or more electrical devices included within the electrical power generation apparatus, the one or more electrical devices electrically coupled to an electrical output of the electrical generator and configured to operate using electrical power provide by the electrical generator.

8. The apparatus of claim 1, wherein the electrical power provided by the electrical generator is a direct current.

9. The apparatus of claim 1, wherein the flow of fluid flowing through the fluid passageway of the conduit comprises production fluid being extracted from the wellbore through the conduit.

10. The apparatus of claim 1, wherein the flow of fluid flowing through the fluid passageway of the conduit comprises drilling fluid.

11. An apparatus comprising:

an electrical power generation apparatus configured to generate electrical power using a flow of fluid flowing through a fluid passageway of a conduit configured as part of a wellbore tubing, the electrical power generation apparatus comprising:

a flow restrictor configured to be deployable to extend into the conduit and interact with a flow of fluid passing through the fluid passageway, the flow restrictor configured to generate a pressure differential between a first opening and a second opening that are both in fluid communication with the fluid passageway and a cavity within the electrical power generation apparatus;

a sleeve that is positioned within the conduit, the sleeve moveable along a longitudinal axis of the conduit between a first position and a second position, wherein when in the first position the sleeve is configured to hold the flow restrictor in a retracted position such that the flow restrictor is not extended into the fluid passageway, and wherein when in the second position the sleeve is configured to allow the flow restrictor to extend into the fluid passageway and to interact with a flow of fluid that is flowing through the fluid passageway; and a mechanical drive mechanism positioned within the cavity and incorporating an electrical generator as part of the mechanical drive mechanism, the mechanical drive mechanism configured as a transverse drive mechanism having a transverse drive axel that is oriented orthogonally to a longitudinal axis of the conduit, the mechanical drive mechanism configured to convert a flow of fluid passing through the cavity into a mechanical rotational movement of the electrical generator to generate electrical power when the electrical generator is being rotated by the flow of fluid passing through the cavity.

12. The apparatus of claim 11, wherein the mechanical drive mechanism includes a rotary wheel having a plurality of blades arranges around an outer circumference of the rotary wheel, the plurality of blades configured to interact with the flow of fluid passing through the cavity and thereby rotating the rotary wheel and rotating some portion of the electrical generator that is coupled to the rotary wheel and thereby causing the electrical generator to generate electrical power.

13. The apparatus of claim 12, wherein a subset of the plurality of blades are positioned along a flow path extending through the cavity regardless of a rotational positioning of the rotary wheel, and wherein the flow path is configured to accommodate a flow of fluid between the first opening and the second opening of the electrical power generation apparatus, thereby interacting with the subset of the plurality of blades positioned along the flow path.

14. The apparatus of claim 11, further comprising:

a set of shoulder elements positioned within the conduit and encircling the longitudinal axis of the conduit, each of the shoulder elements having an inner surface facing toward the longitudinal axis at a same distance radially from the longitudinal axis as an inner surface of the sleeve that faces the longitudinal axis.

15. The apparatus of claim 11, further comprising:

one or more electrical devices included within the electrical power generation apparatus, the one or more electrical devices electrically coupled to an electrical output of the electrical generator and configured to operate using electrical power provide by the electrical generator.

16. A method comprising:

positioning an electrical power generation apparatus at a location within a wellbore, the electrical power generation apparatus including a conduit having a fluid passageway extending through the conduit that is configured to accommodate a flow of fluid through the conduit, the electrical power generation apparatus comprising:

a flow restrictor configured to extend into the conduit and interact with the flow of fluid passing through the fluid passageway, a flow restrictor configured to generate a pressure differential between a first opening and a second opening that are both in fluid communication with the fluid passageway and a cavity within the electrical power generation apparatus, and a mechanical drive mechanism positioned within the cavity and coupled to an electrical generator, the mechanical drive mechanism configured to convert a flow of fluid passing through the cavity into a mechanical rotational movement coupled to the electrical generator, the electrical generator configured to generate electrical power when some portion of the electrical generator is rotated by the mechanical drive mechanism;

extending the flow restrictor from a retracted or covered position to a position where the flow restrictor will engage a fluid flow through fluid passageway, wherein extending the flow restrictor includes moving a sleeve that is positioned within the conduit and that is moveable along a longitudinal axis of the conduit from a first position to a second position, wherein when in the first position the sleeve is holding the flow restrictor in a retracted position such that the flow restrictor is not extended into the fluid passageway, and wherein when in the second position the sleeve is positioned away from the flow restrictor, allowing the flow restrictor to extend into the fluid passageway and to interact with the flow of fluid that is flowing through the fluid passageway;

providing the flow of fluid through the fluid passageway where the flow restrictor has been extended; and generating electrical power using the flow of fluid to operate the mechanical drive mechanism and thereby an input shaft of the electrical generator.

17. The method of claim 16, further comprising:

electrically powering one or more electrical devices included within the electrical power generation apparatus using the electrical power being generated by the electrical generator.

* * * * *